US007441606B2

(12) United States Patent
Maguire

(10) Patent No.: US 7,441,606 B2
(45) Date of Patent: Oct. 28, 2008

(54) EXPANDABLE FLUTED LINER HANGER AND PACKER SYSTEM

(75) Inventor: Patrick Maguire, Cypress, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 298 days.

(21) Appl. No.: 11/343,681

(22) Filed: Jan. 31, 2006

(65) Prior Publication Data

US 2006/0124295 A1 Jun. 15, 2006

Related U.S. Application Data

(63) Continuation-in-part of application No. 10/458,064, filed on Jun. 10, 2003, now Pat. No. 7,028,780, which is a continuation-in-part of application No. 10/428,163, filed on May 1, 2003, now Pat. No. 7,093,656.

(51) Int. Cl.
*E21B 33/10* (2006.01)

(52) U.S. Cl. ..... 166/382; 166/207; 166/208; 166/387

(58) Field of Classification Search ..... 166/380, 166/382, 387, 208, 207, 179
See application file for complete search history.

(56) References Cited

U.S. PATENT DOCUMENTS

| | | | | |
|---|---|---|---|---|
| 1,301,285 | A | 4/1919 | Leonard | |
| 3,179,168 | A | 4/1965 | Vincent | |
| 3,203,451 | A * | 8/1965 | Vincent | 138/143 |
| 3,353,599 | A * | 11/1967 | Swift | 166/278 |
| 3,419,080 | A * | 12/1968 | Lebourg | 166/207 |
| 3,477,506 | A * | 11/1969 | Malone | 166/207 |
| 4,523,641 | A | 6/1985 | Manderscheid | |
| 4,976,322 | A | 12/1990 | Abdrakhamanov et al. | |
| 5,031,699 | A | 7/1991 | Artynov et al. | |
| 5,083,608 | A | 1/1992 | Abdrakhmanov et al. | |
| 5,366,012 | A | 11/1994 | Lohbeck | |
| 5,454,493 | A | 10/1995 | Laroche et al. | |
| 5,620,052 | A | 4/1997 | Turner | |
| 6,012,523 | A | 1/2000 | Campbell et al. | |

(Continued)

FOREIGN PATENT DOCUMENTS

| | | |
|---|---|---|
| GB | 2335683 | 9/1999 |

(Continued)

OTHER PUBLICATIONS

U.K. Search Report, Application No. GB 0409684.8, dated Aug. 6, 2004.

(Continued)

*Primary Examiner*—Hoang Dang
(74) *Attorney, Agent, or Firm*—Patterson & Sheridan, L.L.P.

(57) ABSTRACT

Methods and apparatus create an attachment and a seal between two tubular members in a wellbore. An expandable assembly includes a packer and liner hanger to be expanded into a surrounding tubular. The packer can be a longitudinally corrugated packer and can have a sealing element disposed on an outer surface thereof. The liner hanger can include a plurality of formations extending outward along an outer surface of the liner hanger to form interspaces for longitudinal fluid flow between the formations. In operation, an expansion tool moves axially through an inner diameter of the expandable assembly to expand the liner hanger with a fluted expander and subsequently the packer with a substantially uniform outer diameter cone.

20 Claims, 20 Drawing Sheets

U.S. PATENT DOCUMENTS

| | | | | |
|---|---|---|---|---|
| 6,073,692 | A | 6/2000 | Wood et al. | |
| 6,425,444 | B1 | 7/2002 | Metcalfe et al. | |
| 6,446,724 | B2 | 9/2002 | Baugh et al. | |
| 6,457,532 | B1 | 10/2002 | Simpson | |
| 6,648,075 | B2 | 11/2003 | Badrak et al. | |
| 6,666,276 | B1 | 12/2003 | Yokley et al. | |
| 6,688,397 | B2 | 2/2004 | McClurkin et al. | |
| 6,722,427 | B2 | 4/2004 | Gano et al. | |
| 6,722,441 | B2 | 4/2004 | Lauritzen et al. | |
| 7,111,680 | B2 * | 9/2006 | Duggan | 166/207 |
| 2002/0060079 | A1 | 5/2002 | Metcalfe et al. | |
| 2003/0042022 | A1 | 3/2003 | Lauritzen et al. | |
| 2003/0062171 | A1 | 4/2003 | Maguire et al. | |
| 2003/0098164 | A1 | 5/2003 | Hirth | |
| 2003/0111234 | A1 | 6/2003 | McClurkin et al. | |
| 2003/0131997 | A1 | 7/2003 | Chatterji et al. | |
| 2004/0177953 | A1 | 9/2004 | Wubben | |

FOREIGN PATENT DOCUMENTS

| | | |
|---|---|---|
| GB | 2 345 308 | 7/2000 |
| GB | 2401127 | 3/2004 |
| WO | WO 02/38343 | 5/2002 |
| WO | WO 03/006790 | 1/2003 |
| WO | WO 03/023186 | 3/2003 |

OTHER PUBLICATIONS

GB Search Report, Application No. 0701491.3, Dated Apr. 17, 2007.

* cited by examiner

EXPANDABLE FLUTED LINER HANGER AND PACKER SYSTEM

CROSS-REFERENCE TO RELATED APPLICATIONS

This application is a continuation-in-part of U.S. patent application Ser. No. 10/458,064, entitled EXPANDABLE HANGER WITH COMPLIANT SLIP SYSTEM, filed on Jun. 10, 2003, now U.S. Pat. No. 7,028,780, which is a continuation-in-part of U.S. patent application Ser. No. 10/428,163, entitled SOLID EXPANDABLE HANGER WITH COMPLIANT SLIP SYSTEM, filed on May 1, 2003, now U.S. Pat. No. 7,093,656, which are each herein incorporated by reference.

BACKGROUND OF THE INVENTION

1. Field of the Invention

Embodiments of the invention generally relate to apparatus and methods for creating an attachment and a seal between two tubular members in a wellbore.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth formation. This annular area is filled with cement to permanently set the casing in the wellbore and to facilitate the isolation of production zones and fluids at different depths within the wellbore.

It is common to employ more than one string of casing in a wellbore. In this respect, a first string of casing is set in the wellbore when the well is drilled to a first designated depth. The well is then drilled to a second designated depth and a second string of casing or liner is run into the well to a depth whereby the upper portion of the second liner is overlapping the lower portion of the first string of casing. The second liner string is then fixed or hung in the wellbore usually by some mechanical slip mechanism well known in the art and cemented. This process is typically repeated with additional casing strings until the well has been drilled to total depth.

A recent trend in well completion has been the advent of expandable tubular technology. It has been discovered that both slotted and solid tubulars can be expanded in situ so as to enlarge the inner diameter. This, in turn, enlarges the path through which both fluid and downhole tools may travel. Also, expansion technology enables a smaller tubular to be run into a larger tubular and then expanded so that a portion of the smaller tubular is in contact with the larger tubular therearound. Tubulars are expanded by the use of a cone-shaped mandrel or by a rotary expansion tool with extendable, fluid actuated members disposed on a body and run into the wellbore on a tubular string. An exemplary rotary expansion tool is described in U.S. Pat. No. 6,457,532, issued to Simpson on Oct. 1, 2002, which is herein incorporated by reference in its entirety. During expansion of a tubular, the tubular walls are expanded past their elastic limit. The use of expandable tubulars as liner hangers and packers allows for the use of larger diameter production tubing because the conventional slip mechanism and sealing mechanism are eliminated.

If the liner hanger is expanded by a cone-shaped mandrel, then a forgiving material like an elastomer is typically employed between the outer diameter of the liner hanger and the inner diameter of the larger tubular to accommodate any variances in the inner diameter of the larger tubular. In this particular prior art embodiment, it is this forgiving material that provides the mechanism for hanging the weight of the liner below the liner hanger. Typically, the forgiving material is made from a nitrile rubber compound or a similar material with compliant properties.

When using an expandable liner hanger, it is usually desirable to expand the liner hanger to support the weight of a liner and then release the running tool from the liner prior to cementing the liner in place. Typically, the use of the cone-shaped mandrel requires that circulation ports be cut in the wall of the liner directly below the liner hanger section to provide a fluid path for circulating fluid and cement during the cementing process. Then following the cementing process, these ports must be isolated typically by expanding another elastomer clad section below the ports.

Expanding liner hangers with a cone-shaped mandrel in a wellbore offers advantages over other technology. However, there exist problems associated with using the expandable technology. For example, by using a forgiving material, such as a nitrile rubber compound, the liner hanging mechanism may only be effectively utilized in a wellbore that has a temperature of less than 250° F. If the liner hanger is used in a higher temperature wellbore, then the rubber's ability to carry a load drops off dramatically due to the mechanical properties of the material. More importantly, the circulating ports that are cut into the wall of the liner below the liner hanger diminish the carrying capacity of the hanger due to a reduction of material through this section therefore limiting the length of the liner.

Therefore, there exists a need for systems and methods for an improved expandable hanger and packer arrangement.

SUMMARY OF THE INVENTION

Embodiments of the invention generally relate to apparatus and methods for creating an attachment and a seal between two tubular members in a wellbore. An expandable assembly includes a packer and liner hanger to be expanded into a surrounding tubular. The packer can be a longitudinally corrugated packer and can have a sealing element disposed on an outer surface thereof. The liner hanger can include a plurality of formations extending outward along an outer surface of the liner hanger to form interspaces for longitudinal fluid flow between the formations. In operation, an expansion tool moves axially through an inner diameter of the expandable assembly to expand the liner hanger with a fluted expander and subsequently the packer with a substantially uniform outer diameter cone.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The invention generally relates to a method and an apparatus for forming an expandable hanger connection with a surrounding casing. In one aspect, an expandable hanger with compliant slip system is disclosed. Typically, a liner assembly including a liner hanger is disposed in a wellbore proximate the lower end of the surrounding casing. Next, an expander tool is urged axially through the liner hanger to radially expand the hanger into frictional contact with the surrounding casing and to form a plurality of cement bypass ports. Thereafter, cement is circulated through the wellbore and eventually through the plurality of cement bypass ports to cement the liner assembly within the wellbore. Subsequently, a liner seal is radially expanded to seal off the plurality of cement bypass ports. It should be noted, however, that the expandable hanger with compliant slip system may be used with any expandable tubular, such as a slotted tubular or a screen. In another aspect, a collapsible expander tool for use with the expandable hanger with compliant slip system is disclosed. Generally, the collapsible expander tool includes two opposing cones with a plurality of pads spaced radially around the circumference of the tool. During activation of the collapsible expander tool, the cones converge thereby extending the pads radially outward. Thereafter, the activated expander tool may be employed to radially expand the expandable hanger.

Figure 1:
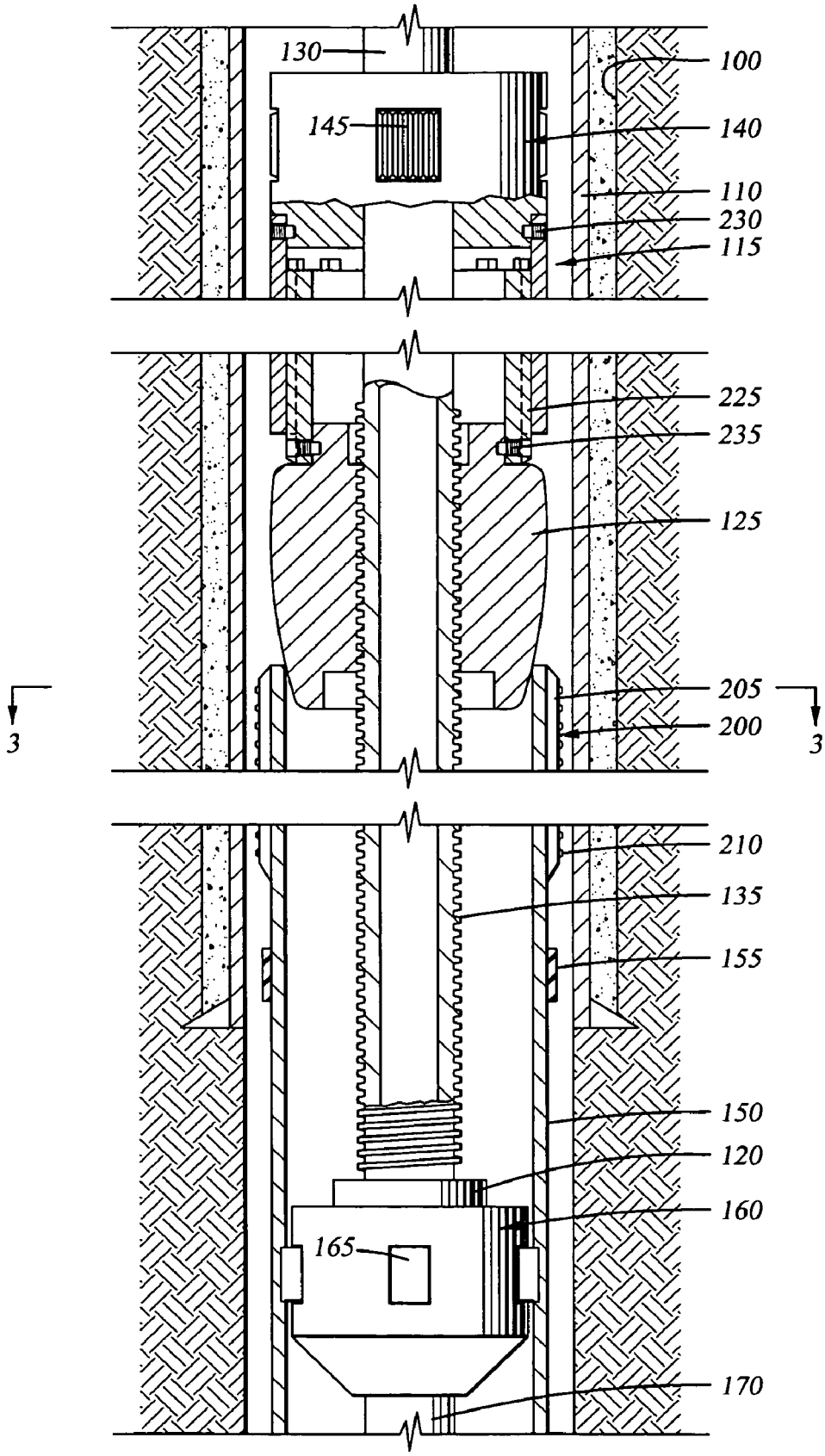
FIG. 1 is a cross-sectional view illustrating an expandable hanger with compliant slip system of the present invention in a run-in position.

FIG. 1 is a cross-sectional view illustrating an expandable hanger 200 of the present invention in a run-in position. At the stage of completion shown in FIG. 1, a wellbore 100 has been lined with a string of casing 110. Thereafter, a subsequent liner assembly 150 is positioned proximate the lower end of the casing 110. Typically, the liner assembly 150 is lowered into the wellbore 100 by a running tool 115 disposed at the lower end of a working string 130.

At the upper end of the running tool 115 is an upper torque anchor 140. Preferably, the torque anchor 140 defines a set of slip members 145 disposed radially around the torque anchor 140. In the embodiment of FIG. 1, the slip members 145 define at least two radially extendable pads with surfaces having gripping formations like teeth formed thereon to prevent rotational movement. As illustrated, the torque anchor 140 is in its recessed position, meaning that the pads 145 are substantially within the plane of the casing 110. In other words, the pads 145 are not in contact with the casing 110 so as to facilitate the run-in of the liner assembly 150. The pads 145 are selectively actuated either hydraulically or mechanically or combinations thereof as known in the art.

A spline assembly 225 is secured at one end to the torque anchor 140 by a plurality of upper torque screws 230 and secured at the other end to an axially movable expander tool 125 by a plurality of lower torque screws 235. As used herein, a spline assembly provides a means of mechanical torque connection between a first and second member. Typically, the first member includes a plurality of keys and the second member includes a plurality of keyways. When rotational torque is applied to the first member, the keys act on the keyways to transmit the torque to the second member. Additionally, the spline assembly permits axial movement between the first and second member while maintaining the torque connection. In this respect, the torque anchor 140 maintains the expander tool 125 rotationally stationary while permitting the expander tool 125 to move axially.

The axially movable expander tool 125 is disposed on a threaded mandrel 135. Expander tools are well known in the art and are generally used to radially enlarge an expandable tubular by urging the expander tool axially through the tubular, thereby swaging the tubular wall radially outward as the larger diameter tool is forced through the smaller diameter tubular member. In the embodiment shown, the expander tool 125 includes female threads formed on an inner surface thereof that mate with male threads formed on the threaded mandrel 135. As the threaded mandrel 135 is rotated, the expander tool 125 moves axially through the hanger 200 to expand it outward in contact with the casing 110. It is to be understood, however, that other means may be employed to urge the expander tool 125 through the hanger 200 such as hydraulics or any other means known in the art. Furthermore, the expander tool 125 may be disposed in the hanger 200 in any orientation, such as in a downward orientation as shown for a top down expansion or in an upward orientation for a bottom up expansion. Additionally, an expandable tool may be employed. Preferably, the expandable tool moves between a first smaller diameter and a second larger diameter, thereby allowing for both a top down expansion and a bottom up expansion depending on the directional axial movement of the expandable tool.

Disposed below the threaded mandrel 135 is a swivel 120. Generally, the swivel 120 permits the relative rotation of a threaded mandrel 135 while the supporting torque anchor 140 and the hanger 200 remain rotationally stationary. A lower anchor 160 with extendable members 165 is located below the swivel 120.

As shown in FIG. 1, the lower anchor 160 is in its extended position, meaning that the extendable members 165 are in contact with the inner surface of the liner assembly 150 so as to secure the liner assembly 150 to the running tool 115. The extendable members 165 are selectively actuated either hydraulically or mechanically or both as known in the art. Furthermore, a fluid outlet 170 is provided at the lower end of the lower anchor 160. The fluid outlet 170 serves as a fluid conduit for cement or other drilling fluid to be circulated into the wellbore 100 in accordance with the method of the present invention.

The liner assembly 150 includes the expandable hanger 200 of this present invention. The expandable hanger 200 comprises of a plurality of formations that are illustrated as a plurality of ribs 205 formed on the outer surface of the hanger 200. The plurality of ribs 205 are circumferentially spaced around the hanger 200 to provide support for the liner assembly 150 upon expansion of the hanger 200. As illustrated, a plurality of inserts 210 are disposed on the ribs 205. The inserts 210 provide a gripping means between the outer surface of the hanger 200 and the inner surface of the casing 110 within which the liner assembly 150 is coaxially disposed. The inserts 210 are made of a suitably hardened material and are attached to the outer surface of the ribs 205 of the hanger 200 through a suitable means such as soldering, epoxying, or other adhesive methods, or via threaded connection. In the preferred embodiment, inserts 210 are press-fitted into preformed apertures in the outer surface of the ribs 205 of the hanger 200. After expansion, the inserts 210 are engaged with the inner surface of the surrounding casing 110, thereby increasing the ability of the expanded hanger 200 to support the weight of the liner assembly 150 below the expanded portion.

In the preferred embodiment, the inserts 210 are fabricated from a tungsten carbide material. However, another fabrication material may be employed, so long as the material has the capability of gripping the inner surface of the casing 110 during expansion of the hanger 200. Examples of fabrication materials for the inserts 210 include ceramic materials (such as carbide) and hardened metal alloy materials. The carbide inserts 210 define raised members fabricated into the hanger 200. However, other embodiments of gripping means may alternatively be employed. Such means include, but are not limited to, buttons having teeth (not shown), or other raised or serrated members on the outer surface of the ribs 205 of the hanger 200. The gripping means may also include a plurality of long inserts defined on the outside diameter of the hanger 200, thus creating a plurality of flutes (not shown) between the plurality of long inserts. Alternatively, the gripping means may define a plurality of hardened tooth patterns added to the outer surface of the ribs 205 of the hanger 200.

In the embodiment shown in FIG. 1, the liner assembly 150 includes a liner seal 155 disposed below the expandable hanger 200. The primary purpose of the liner seal 155 is to seal off the expandable hanger 200 after a cementation operation is complete, as will be discussed in a subsequent paragraph. Generally, the liner seal 155 creates a fluid seal between the liner assembly 150 and the casing 110 upon expansion of the liner seal 155. In the preferred embodiment, the liner seal 155 is fabricated from an elastomeric material. However, other material may be employed that is capable of creating the fluid seal sought to be obtained between the expanded portion of the liner assembly 150 and the casing 110. Typically, the liner seal 155 is disposed around the liner assembly 150 by a thermal process or some other well known means.

Although the liner assembly 150 in FIG. 1 shows only one liner seal 155 disposed below the expandable hanger 200, the invention is not limited to this particular location or the quantity illustrated. For instance, any number of liner seals may be employed with the expandable hanger 200 of the present invention and the liner seals may be placed in any location adjacent the expandable hanger 200 to create a fluid seal between the liner assembly 150 and the casing 110. For example, the liner seal 155 may be employed above the expandable hanger 200 or both above and below the expandable hanger 200 to form a fluid seal between the liner assembly 150 and the casing 110.

Figure 2:
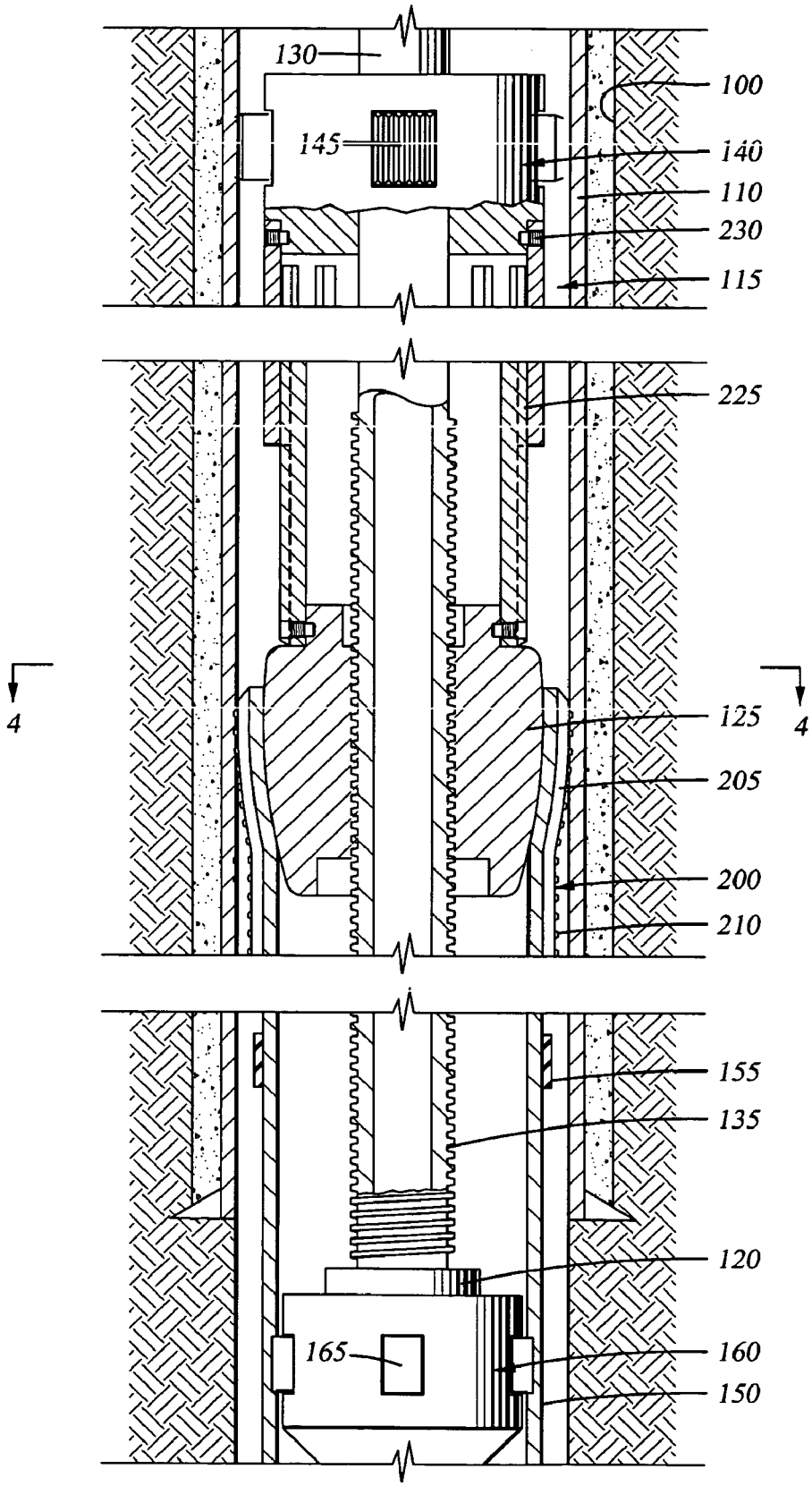
FIG. 2 is a cross-sectional view illustrating an expander tool partially expanding the expandable hanger.

FIG. 2 is a cross-sectional view illustrating the expander tool 125 partially expanding the expandable hanger 200. As shown, the liner assembly 150 is positioned proximate the lower end of the casing 110. Thereafter, the upper torque anchor 140 is actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in a first direction while the torque anchor 140, the spine assembly 225, expander tool 125, and liner assembly 150 remain rotationally stationary. As the threaded mandrel 135 rotates, the expander tool 125 moves axially in a first direction through the expandable hanger 200 causing the hanger 200 to expand radially outward forcing the inserts 210 to contact the inner surface of the casing 110 as illustrated. The expander tool 125 continues to expand the entire length of the expandable hanger 200 until it reaches a predetermined point above the liner seal 155. At that point, the expansion is stopped to prevent expanding the liner seal 155, in anticipation of cementing.

Figure 3:
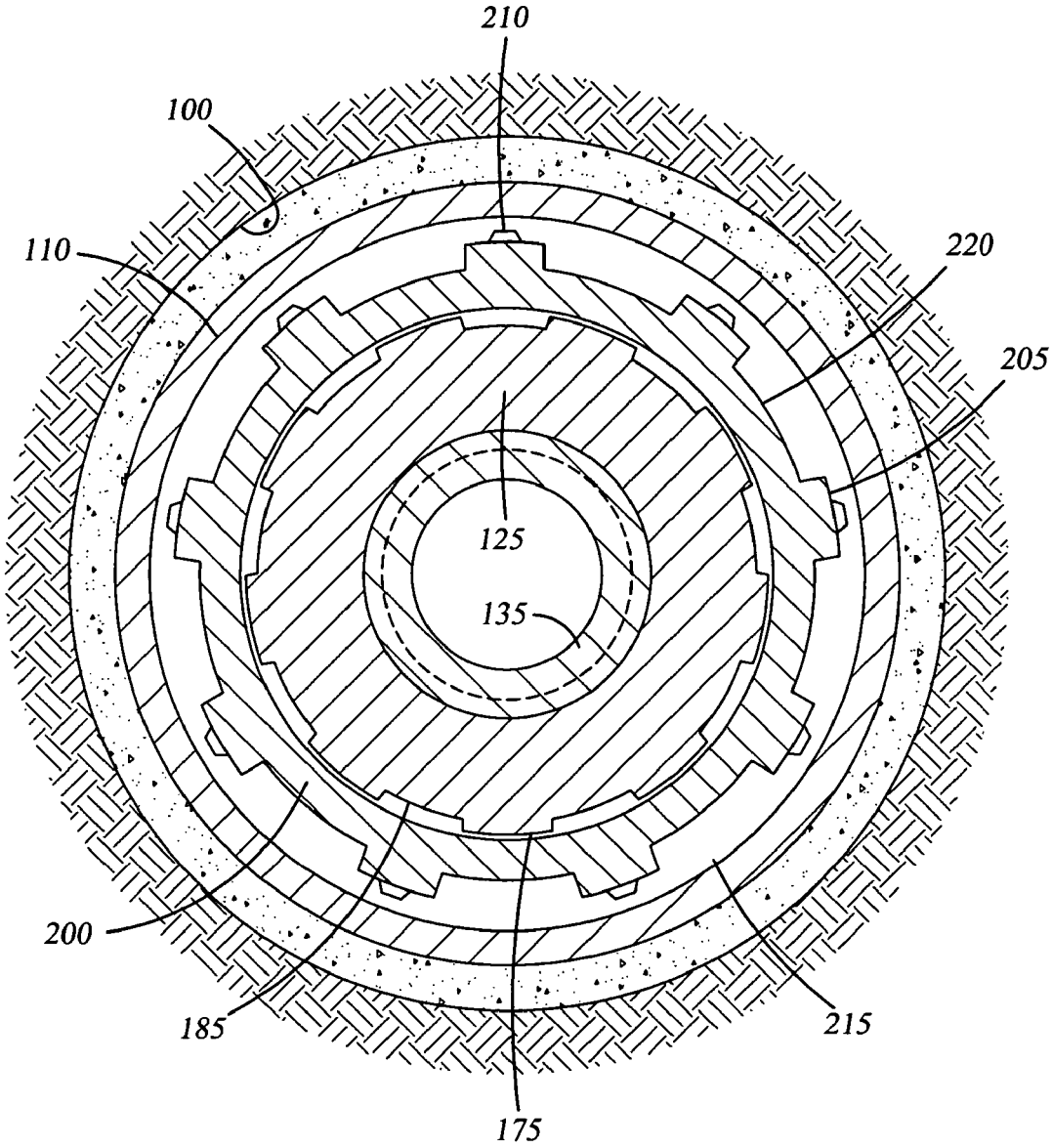
FIG. 3 is a cross-sectional view taken along line 3-3 of FIG. 1 illustrating the expander tool in the expandable hanger prior to expansion.

FIG. 3 is a cross-sectional view taken along line 3-3 in FIG. 1 to illustrate the orientation of the expander tool 125 in the expandable hanger 200. As clearly shown, the expander tool 125 includes a plurality of formations illustrated as a plurality of expander ribs 175 and a plurality of expander flutes 185 circumferentially spaced around the expander tool 125. The plurality of expander ribs 175 are generally tapered members defining a first outer diameter at a first location smaller than a second outer diameter at a second location. Also clearly shown, the hanger 200 includes a plurality of hanger flutes 220 disposed between the plurality of ribs 205.

Figure 4:
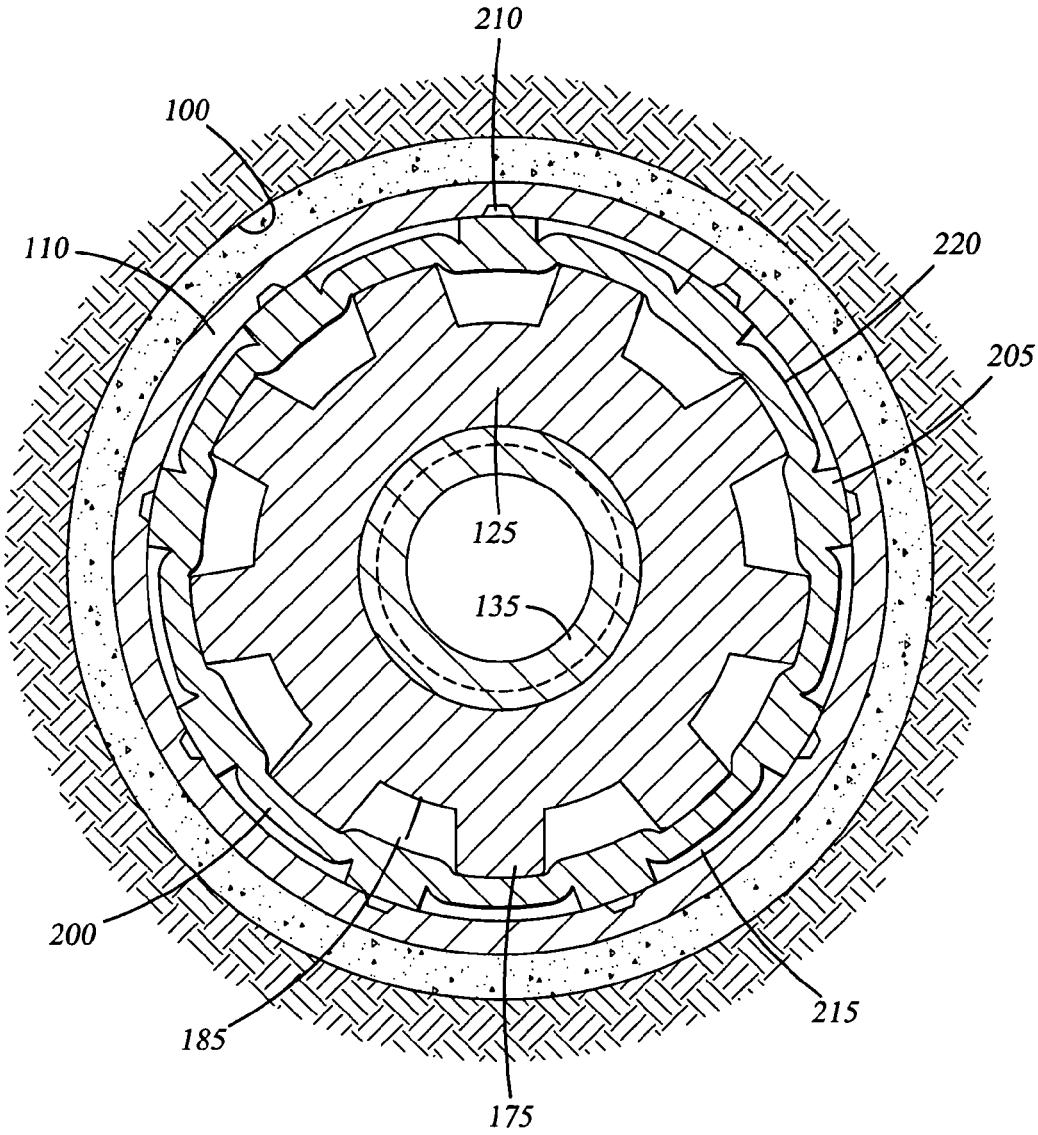
FIG. 4 is a cross-sectional view taken along line 4-4 of FIG. 2 illustrating the expander tool during the expansion of the expandable hanger.

FIG. 4 is a cross-sectional view taken along line 4-4 of FIG. 2 illustrating the expander tool 125 during the expansion of the expandable hanger 200. The expander tool 125 is oriented in the expandable hanger 200 by aligning the plurality flutes 185 with the plurality of ribs 205. Therefore, as the expander tool 125 moves axially through the hanger 200, the ribs 175 apply a force on the hanger flutes 220, causing them to expand out radially, which in turn urges the ribs 205 on the hanger 200 out radially as the inserts 210 penetrate the surrounding casing 110. At this point, the hanger flutes 220 are free to move out radially while the radially stationary ribs 205 are accommodated by the flutes 185. In other words, the expandable hanger 200 includes a compliant slip system that allows the hanger ribs 205 to conform to the surrounding casing 110 as the expander tool 125 urges the expandable hanger 200 radially outward. Given that the radial extension of the hanger flutes 220 are dictated by the diameter of the ribs 175, they never contact the surrounding casing 110. In this manner, the cement bypass ports 215 are formed therefore providing a fluid passageway between the hanger 200 and the surrounding casing 110 during the cementing operation.

Figure 5:
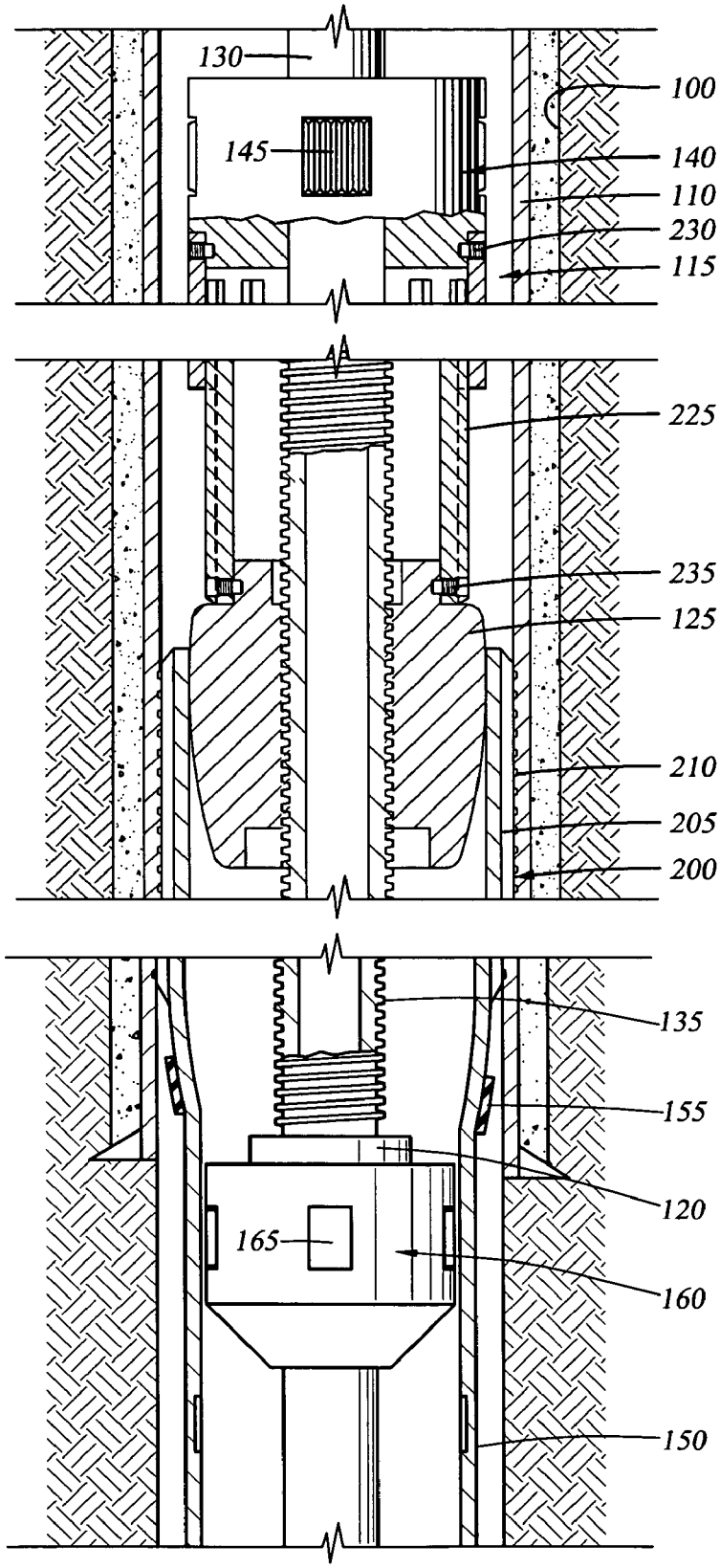
FIG. 5 is a cross-sectional view illustrating the release of the running tool prior to a cementing operation.

FIG. 5 is a cross-sectional view illustrating the release of the running tool 115 prior to a cementing operation. It is desirable to release the running tool 115 from the liner assembly 150 prior to cementing it in the wellbore 100 to prevent the foreseeable difficulty of releasing the tool 115 after the cementation operation. As shown, the torque anchor 140 is also in its recessed position, meaning that the pads 145 have been retracted and are no longer in contact with the casing 110. Furthermore, the hanger 200 supports the weight of the liner assembly 150 therefore the lower anchor 160 is deactivated, meaning that the extendable members 165 have been retracted and are no longer in contact with the inner surface of the liner assembly 150 so as to release the liner assembly 150 from the running tool 115.

Figure 6:
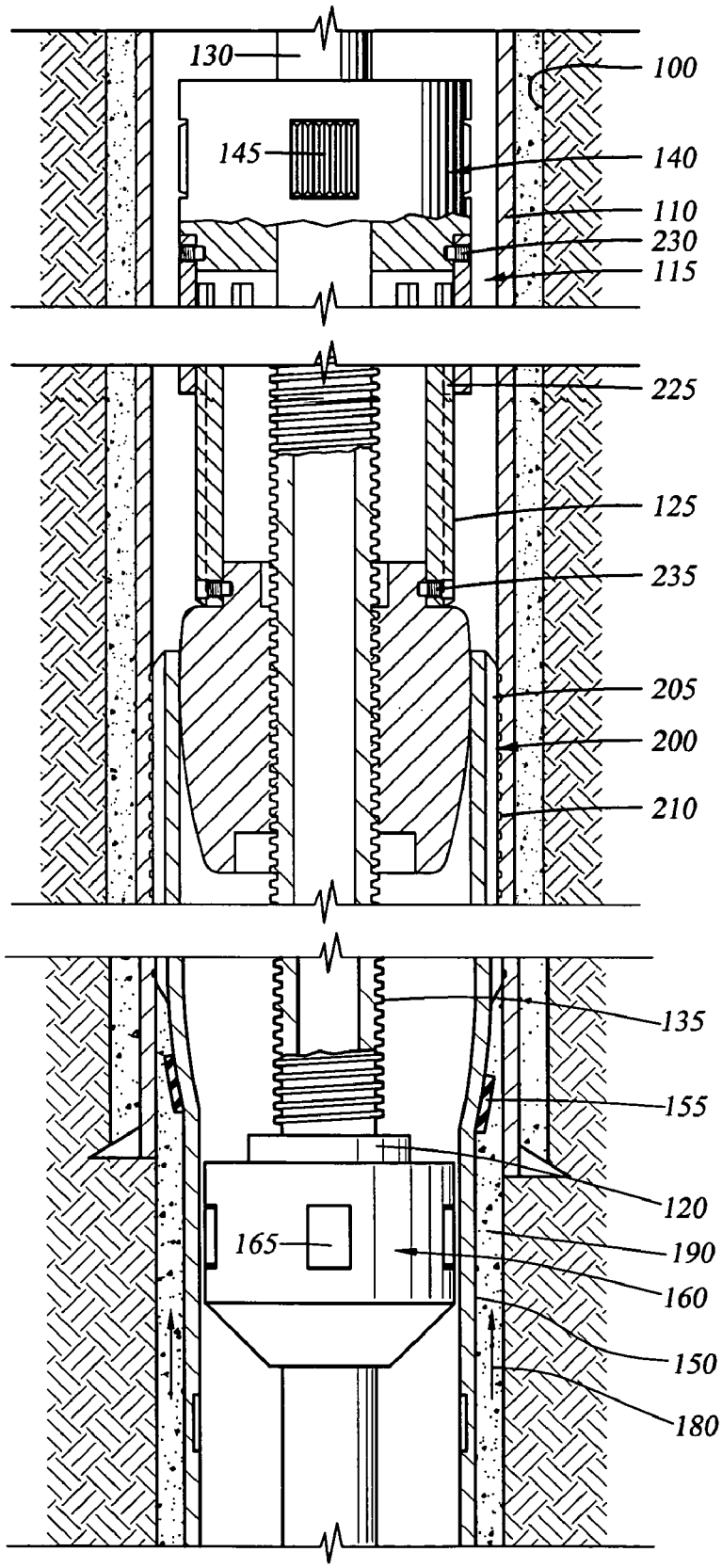
FIG. 6 is a cross-sectional view illustrating the cementation of the liner assembly within the wellbore.

FIG. 6 is a cross-sectional view illustrating the cementation of the liner assembly 150 within the wellbore 100. Preferably, cement is pumped through the working string 130, the running tool 115, and the fluid outlet 170 to a cement shoe (not shown) or another means known in the art to distribute the cement. As indicated by arrow 180, the cement is circulated up an annulus 190 formed between the liner assembly 150 and the wellbore 100 and past the liner seal 155 into the cement bypass ports (not shown) of the expandable hanger 200. Thereafter, the cement flows through the bypass ports and exits into the inner diameter of the surrounding casing 110.

Figure 7:
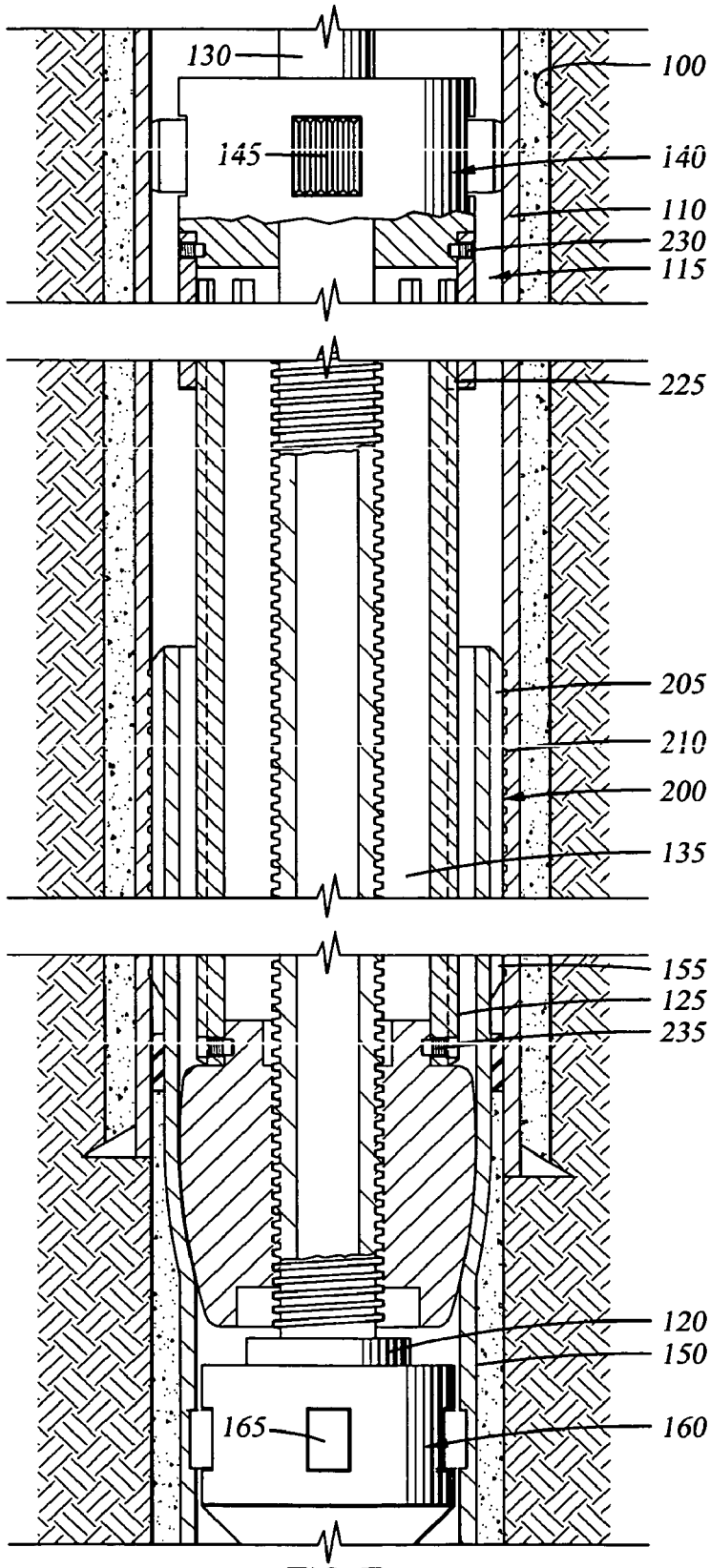
FIG. 7 is a cross-sectional view illustrating the expansion of the liner seal after the cementing operation.

FIG. 7 is a cross-sectional view illustrating the expansion of the liner seal 155 after the cementing operation. As shown, the liner assembly 150 has been completely cemented in the wellbore 100. As further shown, the torque anchor 140 and lower anchor 160 are once again actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate in the first direction while the supporting torque anchor 140, the spline assembly 225, and the expander tool 125 remain rotationally stationary. As the threaded mandrel 135 rotates in the first direction, the expander tool 125 moves axially in the first direction through the expanded portion of the hanger 200 to a predetermined location above the liner seal 155.

Thereafter, a plurality of selectively extendable elements (not shown) are activated. Referring to FIG. 4, the plurality of selectively extendable elements are preferably disposed in the plurality of expander flutes 185. The plurality of extendable elements are constructed and arranged to extend radially outward to substantially fill in the expander flutes 185 which results in an expander tool with a substantially uniform outer diameter capable of expanding the entire outer perimeter of the liner seal 155. The extendable elements may be a selectively movable piston, an extendable dog assembly, a collet assembly, or any other suitable member to fill the plurality of expander flutes 185.

Referring back to FIG. 7, the expander tool 125 with the activated extendable elements moves axially through the liner seal 155, thereby expanding the entire perimeter of the liner seal 155 radially outward forcing the elastomeric material to form a fluid seal between the liner assembly 150 and the surrounding casing 110. Alternatively, a rotary expansion tool with extendable members (not shown) or a cone shaped mandrel (not shown) may be employed to expand the liner seal 155. Additionally, the expander tool 125 could be rotated to expand the liner seal 155. In either case, the cement bypass ports (not shown) are sealed off to prevent any further migration of fluid through the expandable hanger 200 from micro-annuluses that may have formed during the cementing operation.

Figure 8:
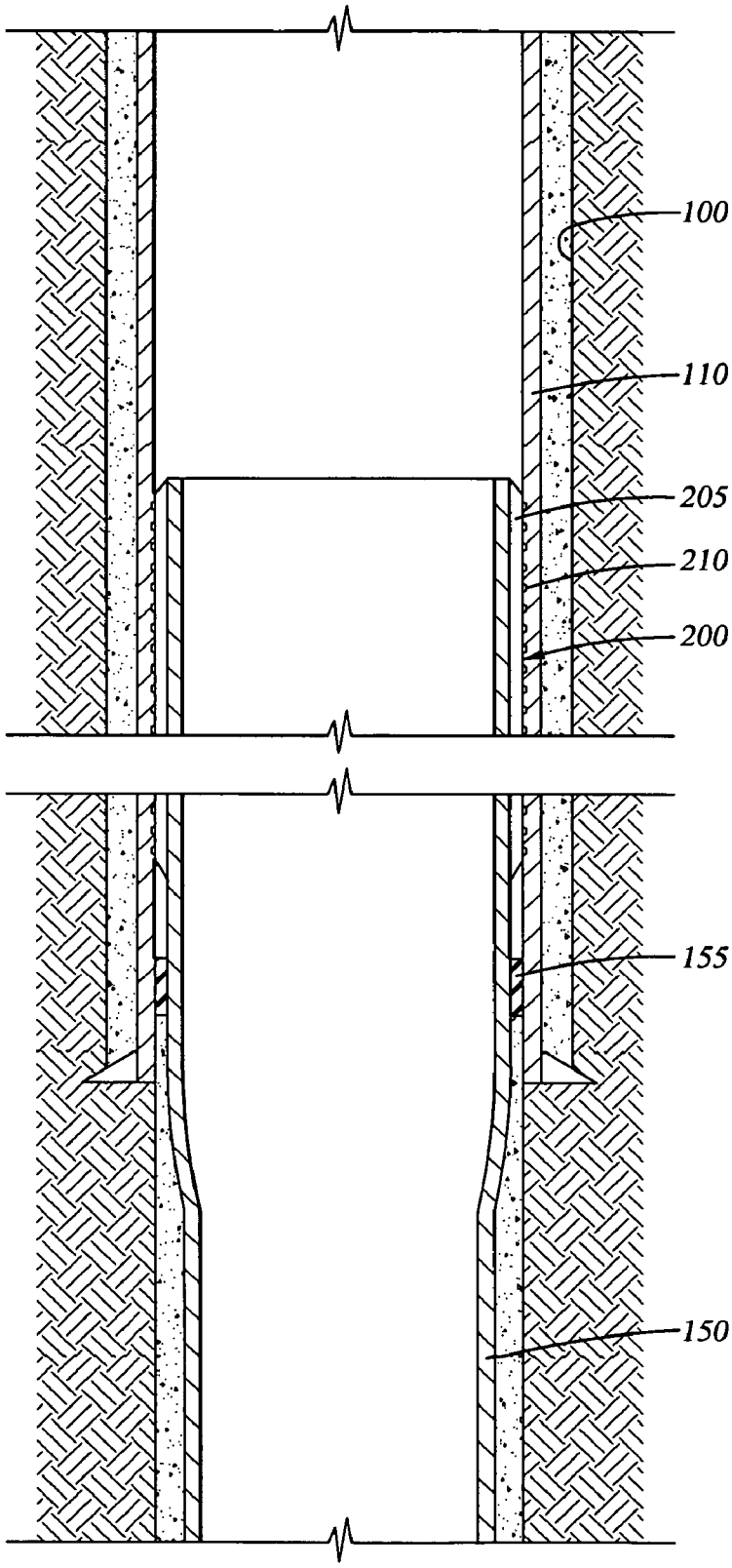
FIG. 8 is a cross-sectional view illustrating the fully expanded expandable hanger after the running tool has been removed.

FIG. 8 is a cross-sectional view illustrating the fully expanded expandable hanger 200 after the running tool 115 has been removed. As shown, the expandable hanger 200 is fully engaged with the lower portion of the surrounding casing 110 and consequently supporting the entire weight of the liner assembly 150 by way of the inserts 210 on the hanger ribs 205. As further shown, the liner seal 155 has been expanded radially outward and is therefore creating the lower fluid seal between the liner assembly 150 and the surrounding casing 110.

Creating an attachment and a seal between two tubulars in a wellbore can be accomplished with methods that use embodiments of the expandable hanger as described above. A method of completing a wellbore includes placing a first tubular coaxially within a portion of a second tubular, the first tubular including a plurality of formations on an outer surface thereof to provide a frictional relationship between the first tubular and the second tubular while leaving a fluid path through the expanded connection. The method also includes positioning an expander tool within the first tubular at a depth proximate the plurality of formations on the first tubular. The method further includes urging the expander tool axially through the first tubular to expand the first tubular into frictional contact with the second tubular and forming a fluid path through an overlapped portion between the first and second tubulars. Therefore, the apparatus and methods disclosed herein for using embodiments of the expandable hanger permits the connection of two tubulars within a wellbore.

In another aspect, a collapsible expander tool for use with the expandable hanger with compliant slip system is disclosed. It should be noted, however, that the collapsible expander tool may be employed with other expandable tubulars, such as expandable screens and expandable casing.

Figure 9:
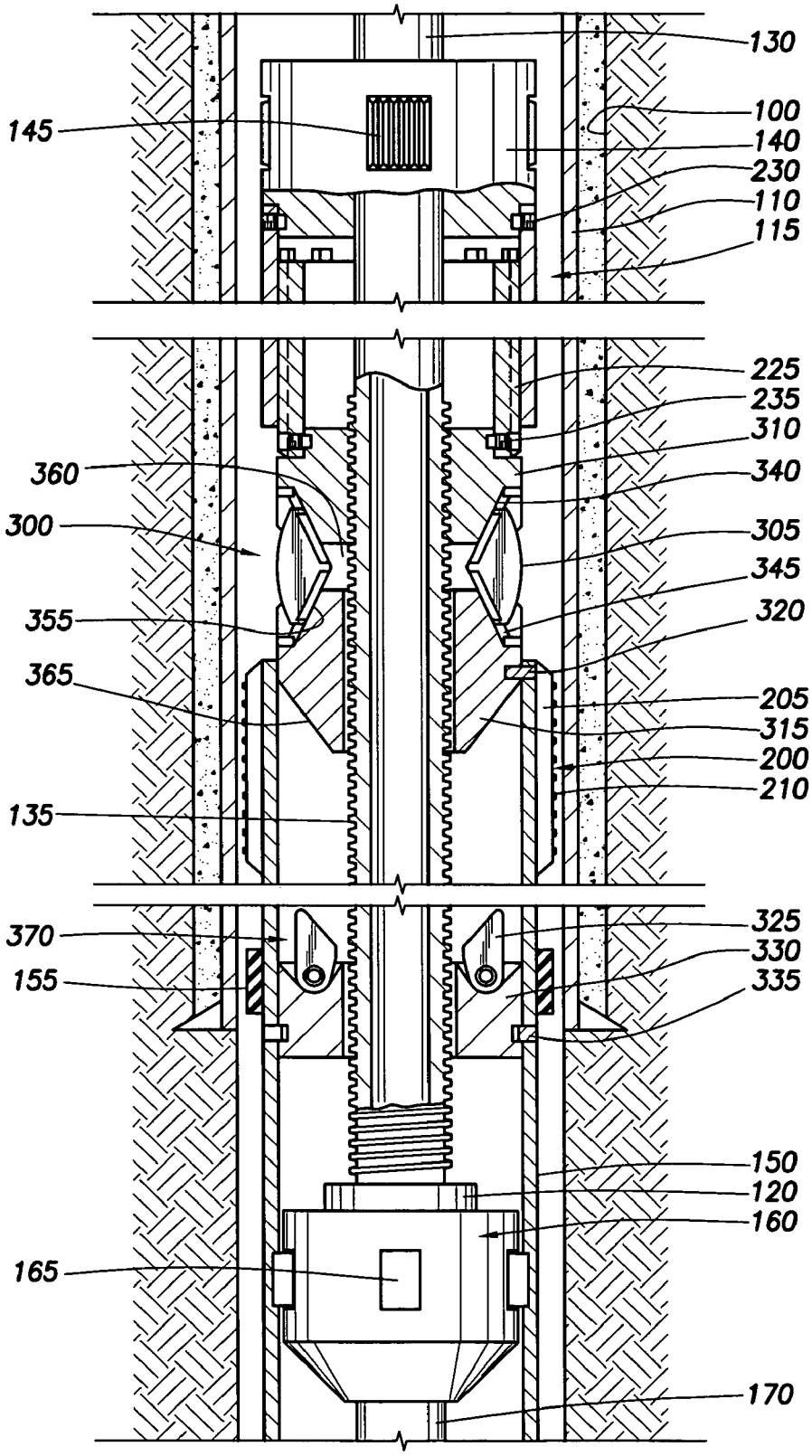
FIG. 9 is a cross-sectional view illustrating a collapsible expander tool in the expandable hanger with compliant slip system.

FIG. 9 is a cross-sectional view illustrating a collapsible expander tool in the expandable hanger 200 with compliant slip system. For convenience, the components in FIGS. 9-17 that are similar to the components as described in FIGS. 1-8 will be labeled with the same numbers. As discussed in a previous paragraph, a liner assembly 150 is lowered into the wellbore 100 by a running tool 115 disposed at the lower end of a working string 130.

As shown in FIG. 9, the collapsible expander tool 300 is in a collapsed run-in position. The upper end of the collapsible expander tool 300 is secured to a spline assembly 225 by a plurality of lower torque screws 235 while the lower end of the collapsible expander tool 300 is temporality attached to the liner assembly 150 by a plurality of shear pins 320. Additionally, the collapsible expander tool 300 is disposed on a threaded mandrel 135. Preferably, the expander tool 300 includes female threads formed on an inner surface thereof that mate with male threads formed on the threaded mandrel 135. Generally, the rotation of the threaded mandrel 135 activates the expander tool 300 and moves it axially through the hanger 200. It is to be understood, however, that other means may be employed to urge the expander tool 300 through the hanger 200, such as hydraulics, mechanical manipulation, or combinations thereof as known in the art.

Furthermore, the expander tool 300 may be disposed in the hanger 200 in any orientation, such as in a downward orientation as shown for a top down expansion, an upward orientation for a bottom up expansion, or placed in the middle of the hanger 200 for expansion in either direction.

As illustrated in FIG. 9, the collapsible expander tool 300 includes an upper cone 310 and a lower cone 315. The cones 310, 315 are spaced apart to form a gap 360 therebetween. The upper cone 310 includes a tapered portion 340 disposed adjacent a first tapered portion 345 on the lower cone 315 to form a profile. The lower cone 315 further includes a second tapered portion 365 formed at the lower end thereof. The collapsible expander tool 300 further includes a plurality of selectively extendable members, such as a plurality of pads 305 spaced radially around the expander tool 300. The inner portion of the pads 305 includes a ramp portion 355 that mates with a contour formed by the tapered portions 340, 345. The outer portion of the pads 305 includes a profile, such as a radius profile, to increase the contact stresses between the expander tool 300 and the material to be expanded.

As further illustrated, a dog assembly 370 is disposed below the expander tool 300 and proximate the liner seal 155. The dog assembly 370 includes a plurality of dogs 325 constructed and circumferentially arranged around a support 330. A shearable member, such as a shear ring 335, operatively attaches the support 330 to the liner assembly 150.

Figure 10:
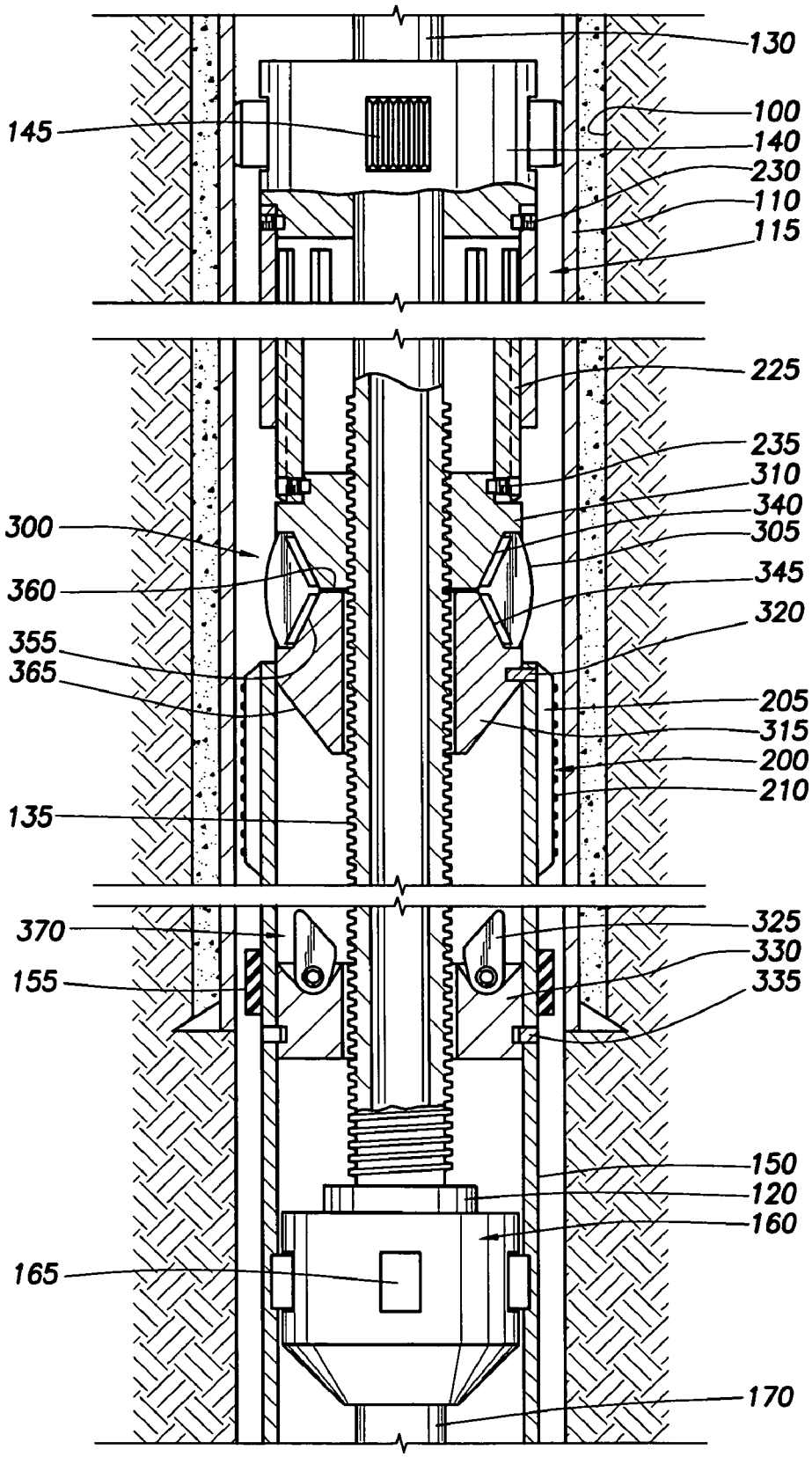
FIG. 10 is a cross-sectional view illustrating the collapsible expander tool in an activated position prior to the expansion of the expandable hanger.

FIG. 10 is a cross-sectional view illustrating the collapsible expander tool 300 in an activated position prior to the expansion of the expandable hanger 200. As shown, the liner assembly 150 is positioned proximate the lower end of the casing 110. Thereafter, the upper torque anchor 140 is actuated, thereby extending the pads 145 radially outward into contact with the surrounding casing 110. Subsequently, rotational force is transmitted through the working string 130 to the threaded mandrel 135. The swivel 120 permits the threaded mandrel 135 to rotate while the torque anchor 140, the spline assembly 225, expander tool 300, and liner assembly 150 remain rotationally stationary. As the threaded mandrel 135 rotates, the upper cone 310 moves axially toward the lower cone 315 closing the gap 360. At the same time, the pads 305 move radially outward as the ramped portion 355 rides up the tapered portions 340, 345. After the upper cone 310 is in substantial contact with the lower cone 315, the entire expander tool 300 creates a force on the plurality of shear pins 320. At a predetermined force, the shear pins 320 fail thereby permitting the expander tool 300 to move axially within the hanger 200.

Figure 11:
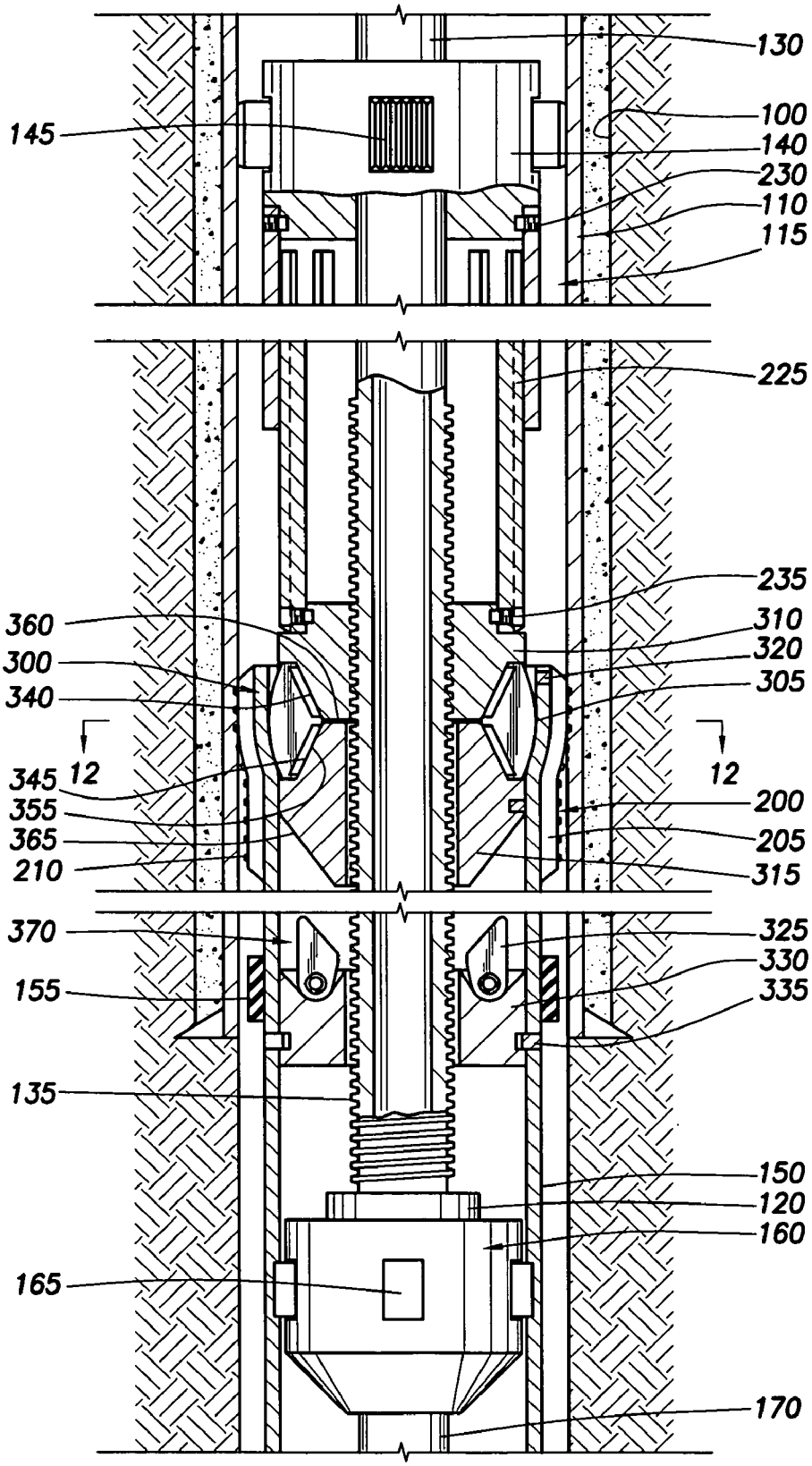
FIG. 11 is a cross-sectional view illustrating the expander tool partially expanding the expandable hanger.

FIG. 11 is a cross-sectional view illustrating the expander tool 300 partially expanding the expandable hanger 200. As the threaded mandrel 135 rotates, the expander tool 300 moves axially through the expandable hanger 200 forcing the inserts 210 to contact the inner surface of the casing 110 as the hanger 200 expands radially outward. The expander tool 300 continues to expand the entire length of the expandable hanger 200 until it reaches a predetermined point above the liner seal 155. At that point, the expansion is stopped to prevent expanding the liner seal 155, in anticipation of cementing.

Figure 12:
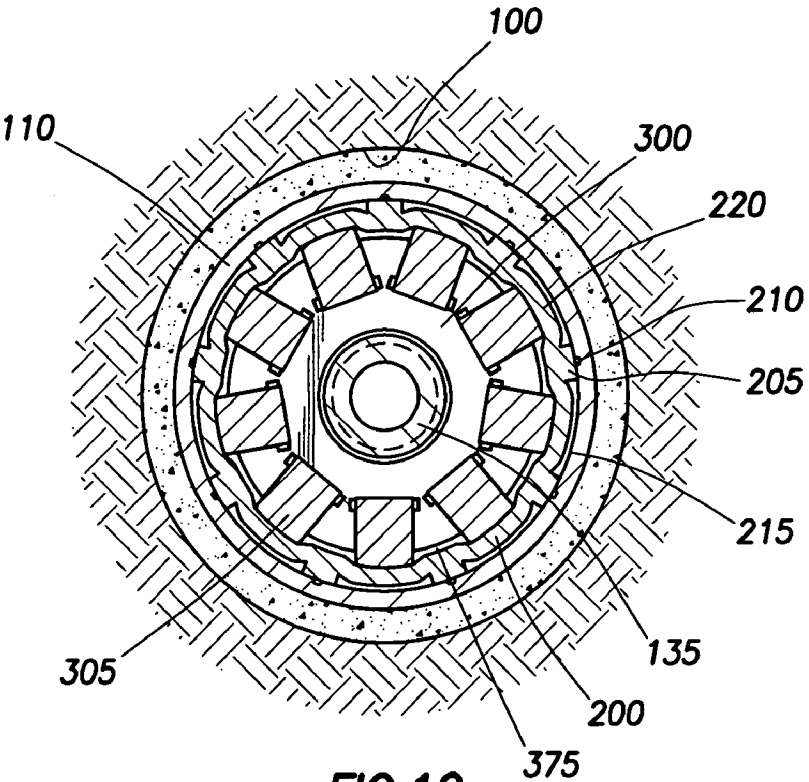
FIG. 12 is a cross-sectional view taken along line 12-12 in FIG. 11 illustrating the expander tool during the expansion of the expandable hanger.

FIG. 12 is a cross-sectional view taken along line 12-12 in FIG. 11 illustrating the expander tool 300 during the expansion of the expandable hanger 200. As clearly shown, the plurality of pads 305 are circumferentially spaced around the expander tool 300 and the plurality of pads 305 are aligned with the hanger flutes 220. Therefore, as the expander tool 300 moves axially through the hanger 200, the plurality of pads 305 apply a force on the hanger flutes 220, causing them to expand out radially, which in turn urges the ribs 205 on the hanger 200 out radially as the inserts 210 penetrate the surrounding casing 110. At this point, the hanger flutes 220 are free to move out radially while the flutes 185 accommodate the radially stationary ribs 205. In other words, the expandable hanger 200 includes a compliant slip system that allows the hanger ribs 205 to conform to the surrounding casing 110 as the expander tool 300 urges the expandable hanger 200 radially outward. Given that the radial extension of the hanger flutes 220 are dictated by the diameter of the pads 305, they never contact the surrounding casing 110. In this manner, the cement bypass ports 215 are formed thereby providing a fluid passageway between the hanger 200 and the surrounding casing 110 during the cementing operation.

Figure 13:
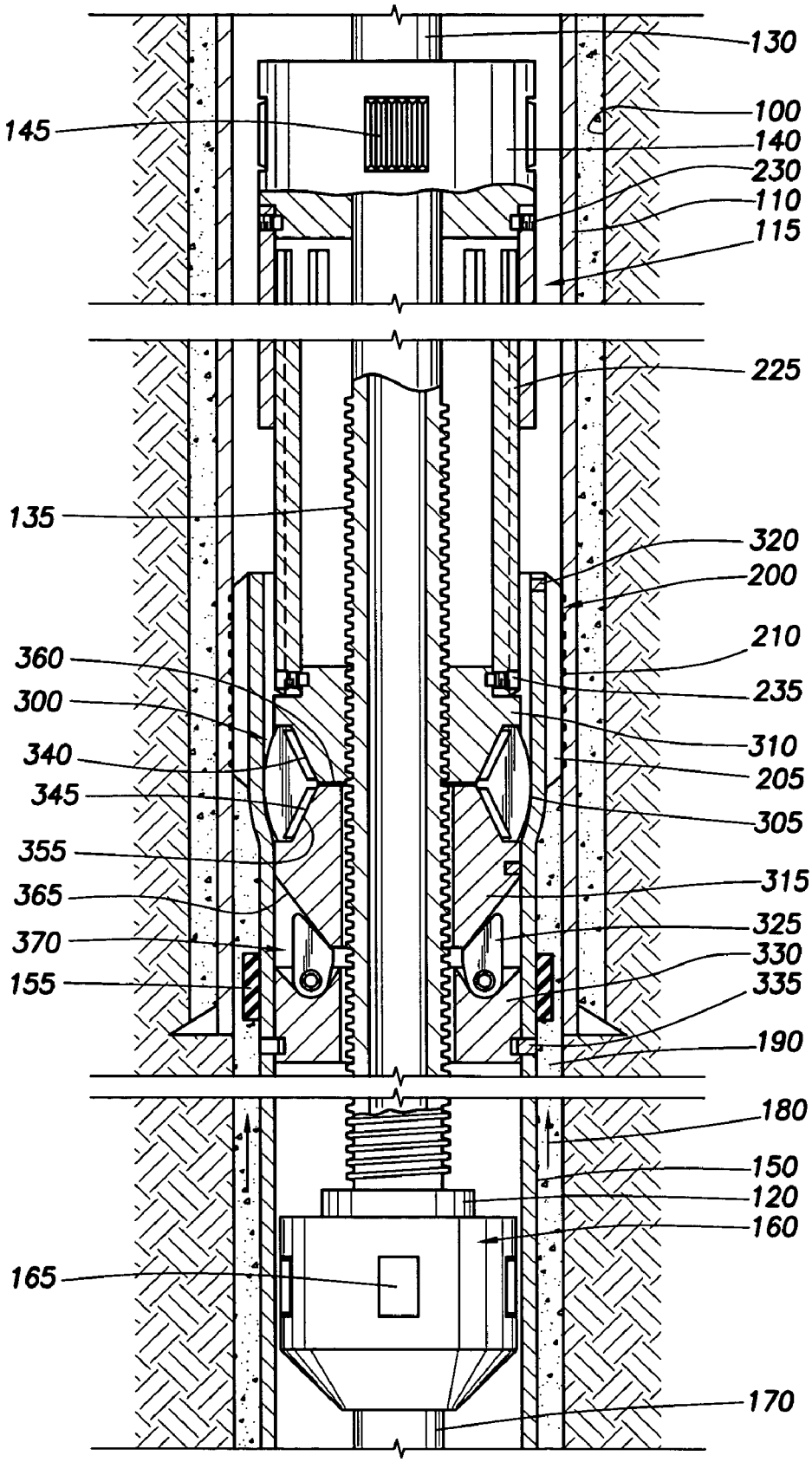
FIG. 13 is a cross-sectional view illustrating the cementation of the liner assembly within the wellbore.

FIG. 13 is a cross-sectional view illustrating the cementation of the liner assembly 150 within the wellbore 100. After the hanger 200 is expanded to the predetermined point above the liner seal 155, the expander tool 300 is moved proximate the top of the hanger 200. Thereafter, the torque anchor 140 and lower anchor 160 are deactivated and then cement is pumped through the working string 130, the running tool 115, and the fluid outlet 170 to a cement shoe (not shown) or another means known in the art to distribute the cement. As indicated by arrow 180, the cement is circulated up an annulus 190 formed between the liner assembly 150 and the wellbore 100 and past the liner seal 155 into the cement bypass ports (not shown) of the expandable hanger 200. Thereafter, the cement flows through the bypass ports and exits into an inner diameter of the surrounding casing 110.

Figure 14:
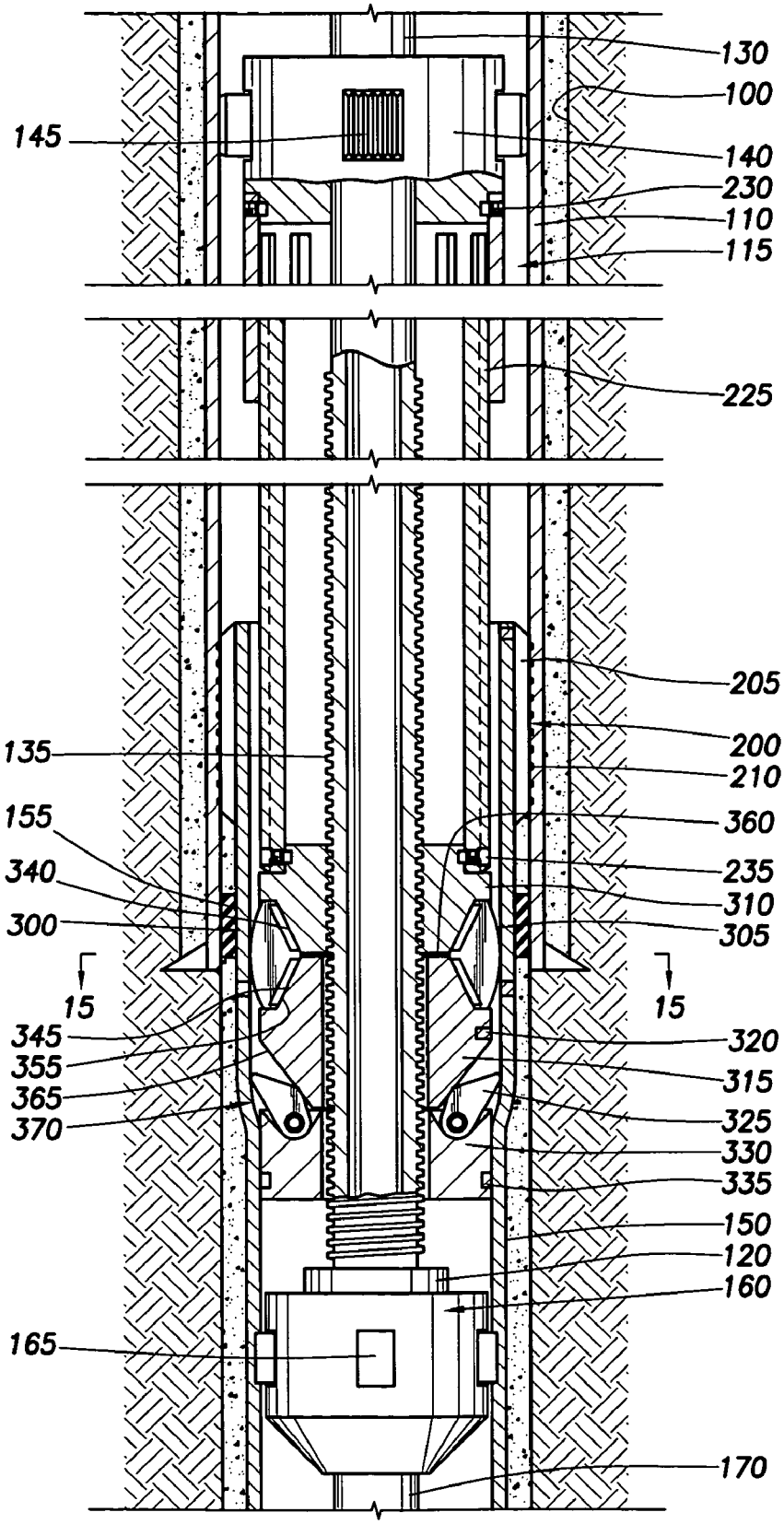
FIG. 14 is a cross-sectional view illustrating the expansion of the liner seal after the cementing operation.

FIG. 14 is a cross-sectional view illustrating the expansion of the liner seal 155 after the cementing operation. As shown, the liner assembly 150 has been completely cemented in the wellbore 100. As further shown, the torque anchor 140 and lower anchor 160 are once again actuated, thereby extending the pads 145, 165 radially outward. Subsequently, rotational force is transmitted through the working string 130 to the threaded mandrel 135. The swivel 120 permits the threaded mandrel 135 to rotate while the supporting torque anchor 140, the spline assembly 225, and the expander tool 300 remain rotationally stationary. As the threaded mandrel 135 rotates, the expander tool 300 moves axially through the expanded portion of the hanger 200 until the lower cone 315 contacts the plurality of dogs 325. At that point, the second tapered portion 365 urges the plurality of dogs 325 radially outward into contact with the surrounding hanger 200 and at the same time creates an axial force on the shear ring 335. At a predetermined force, the shear ring 335 fails thereby permitting the expander tool 300 and the dog assembly 370 to move axially in the liner assembly 150. The axial movement of the expander tool 300 and the dog assembly 370 expands the liner seal 155 radially outward forcing the elastomeric material to form a fluid seal between the liner assembly 150 and the surrounding casing 110.

Figure 15:
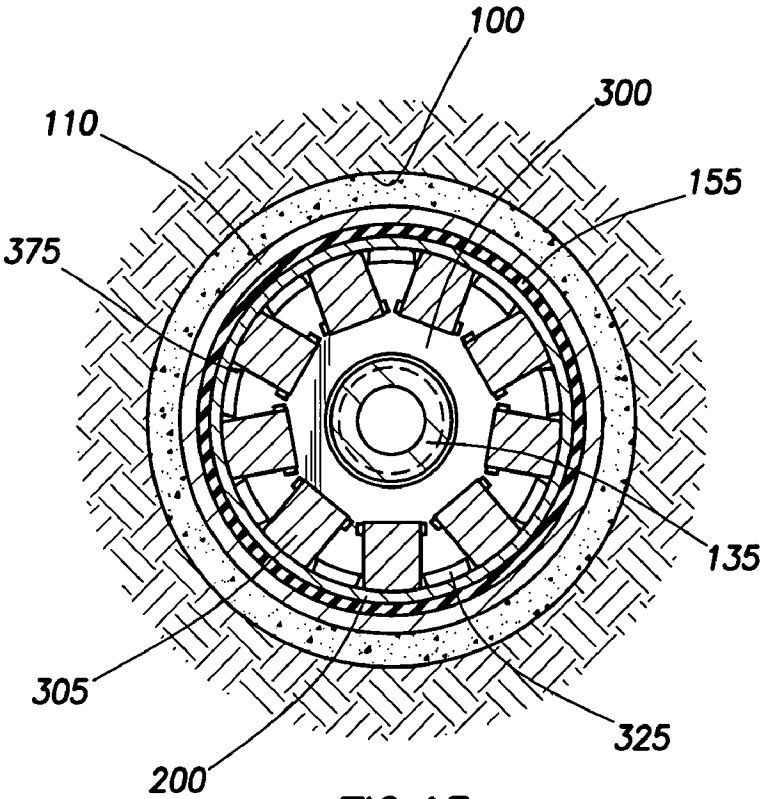
FIG. 15 is a cross-sectional view taken along line 15-15 in FIG. 14 illustrating the expander tool and the plurality of dogs during the expansion of the liner seal.

FIG. 15 is a cross-sectional view taken along line 15-15 in FIG. 14 illustrating the expander tool 300 and the plurality of dogs 325 during the expansion of the liner seal 155. As clearly shown, the plurality of dogs 325 are spaced circumferentially between the plurality of pads 305 to fill a plurality of spaces 375. It should be understood, however, that other components may be employed to fill the spaces 375 between the pads 305, such as collet or any other suitable components known in the art.

In the embodiment shown, the entire outer perimeter of the liner seal 155 is radially expanded into contact with the surrounding casing 110. In other words, after the plurality of dogs 325 expand a portion of the liner seal 155 into contact with the casing 110 then the plurality of pads 305 expand the remainder of the liner seal 155 into contact with the casing 110. In this manner, the cement bypass ports (not shown) are sealed off to prevent any further migration of fluid through the expandable hanger 200 from micro-annuluses that may have formed during the cementing operation.

Figure 16:
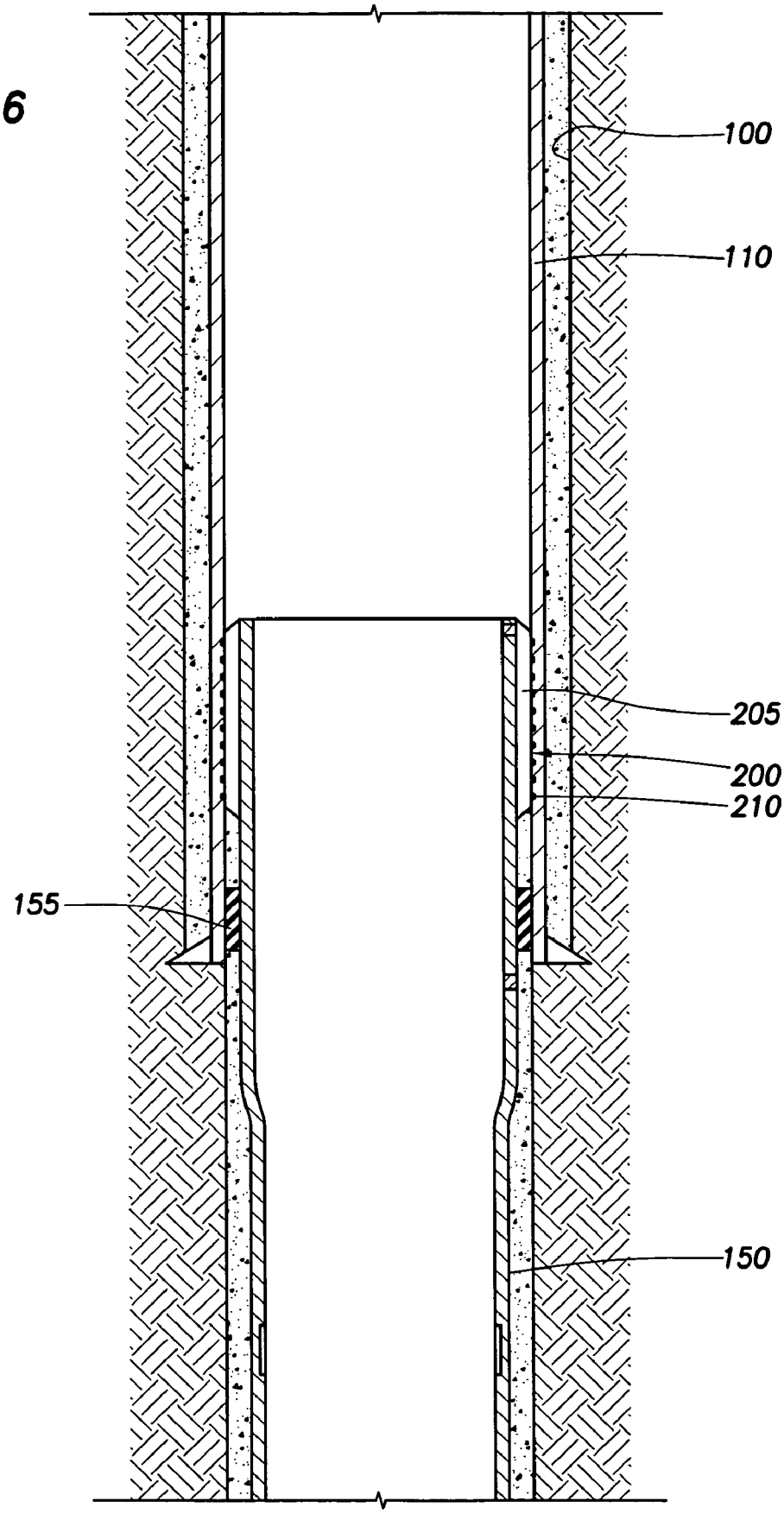
FIG. 16 is a cross-sectional view illustrating the fully expanded expandable hanger after the running tool has been removed.

FIG. 16 is a cross-sectional view illustrating the fully expanded expandable hanger 200 after the running tool 115 has been removed. As shown, the expandable hanger 200 is fully engaged with the lower portion of the surrounding casing 110 and consequently supporting the entire weight of the liner assembly 150 by way of the inserts 210 on the hanger ribs 205. As further shown, the liner seal 155 has been expanded radially outward and is therefore creating the lower fluid seal between the liner assembly 150 and the surrounding casing 110.

Figure 17:
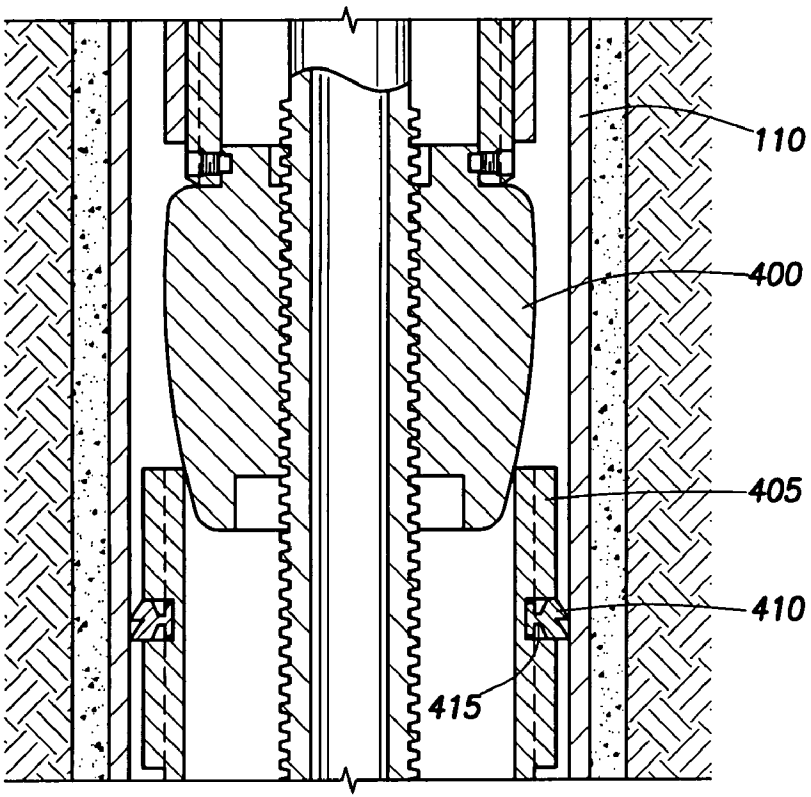
FIG. 17 is a cross-sectional view illustrating an alternative embodiment of an expandable hanger with compliant slip system.

FIG. 17 is a cross-sectional view illustrating an alternative embodiment of an expandable hanger 405 with compliant slip system. In this embodiment, the expandable hanger 405 includes a plurality of griping members 410 disposed circumferentially therearound. The gripping members 410 include a reduced portion 415 that is constructed and arranged to buckle or fail at a predetermined load. In other words, the expandable hanger 405 includes a compliant slip system that allows the gripping members 410 to conform the hanger 405 to a surrounding casing 110 as an expander tool 400 urges the expandable hanger 405 radially outward.

Figure 18:
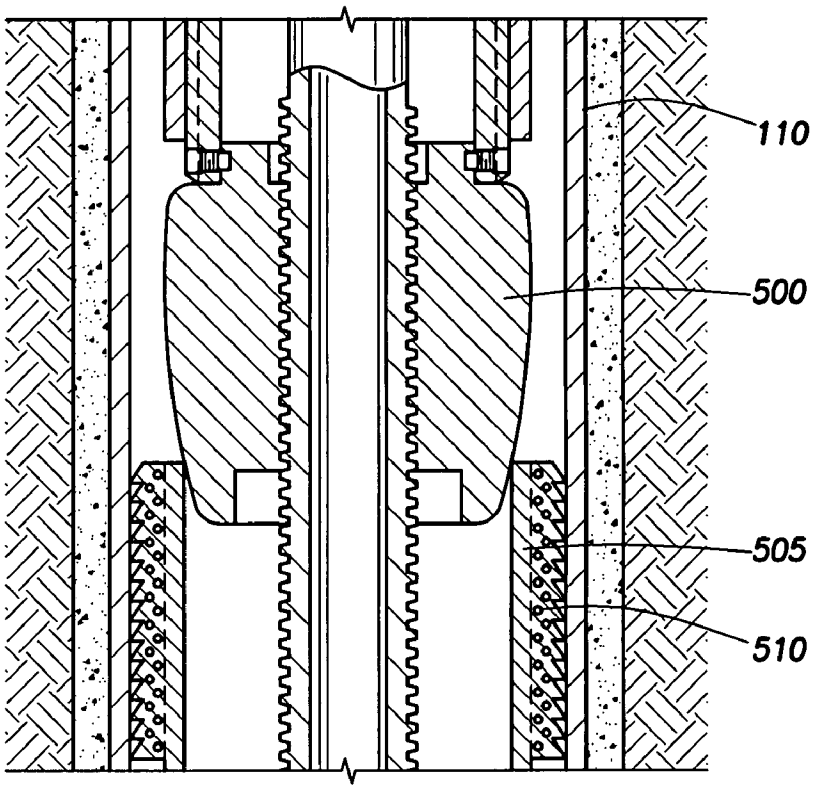
FIG. 18 is a cross-sectional view illustrating an alternative embodiment of an expandable hanger with compliant slip system.

FIG. 18 is a cross-sectional view illustrating an alternative embodiment of an expandable hanger 505 with compliant slip system. In this embodiment, the expandable hanger 505 includes a plurality of holes 510 formed in the hanger 505. The plurality of holes 510 are constructed and arranged to collapse at a predetermined load. In other words, the expandable hanger 505 includes a compliant slip system that allows the hanger 505 to conform to a surrounding casing 110 as an expander tool 500 urges the expandable hanger 505 radially outward.

Figure 19:
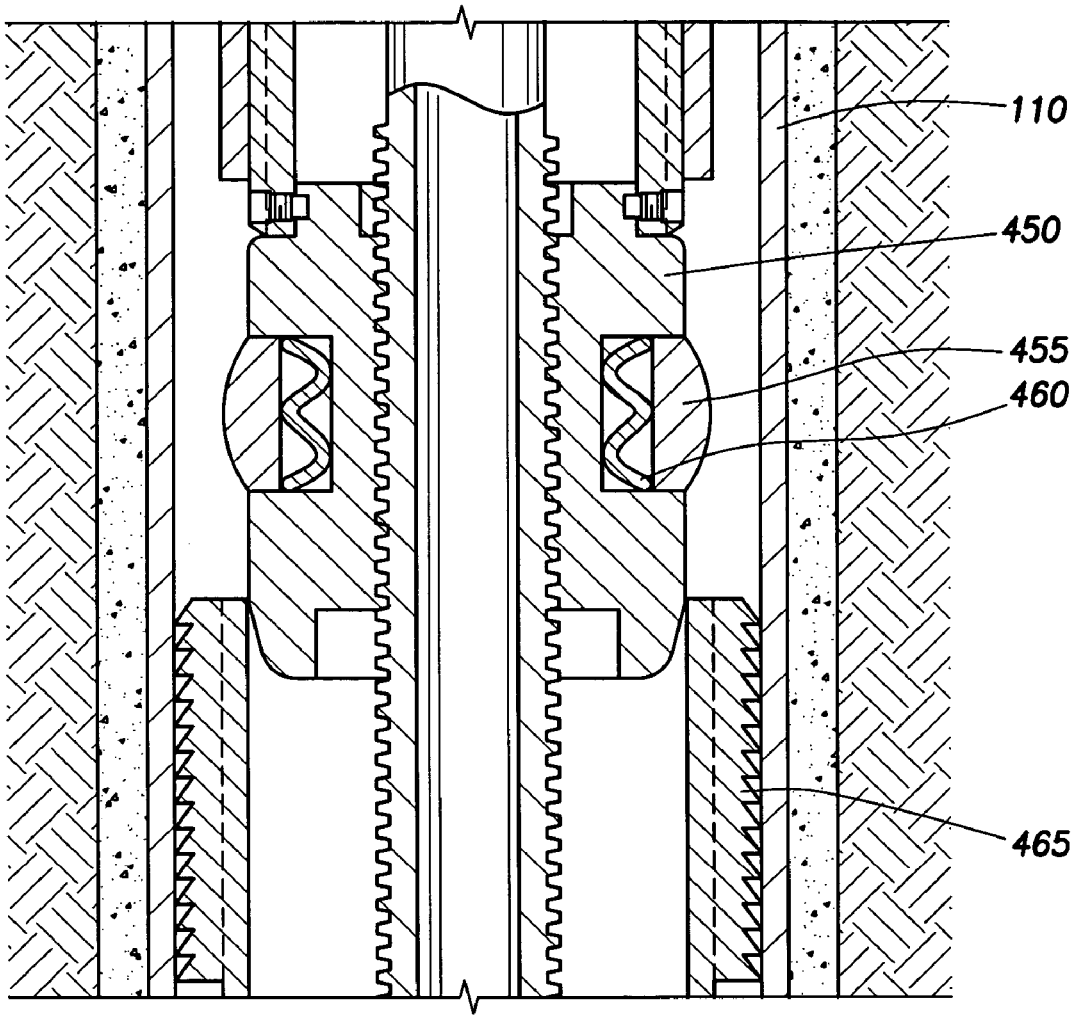
FIG. 19 is a cross-sectional view illustrating an expander tool with compliant expansion member.

FIG. 19 shows a cross-sectional view illustrating an expander tool 450 with compliant expansion member 455. In this embodiment, the expander tool 450 includes a forgiving member 460 disposed behind the expansion member 455. The forgiving member 460 is constructed and arranged to deform at a predetermined load. In other words, the expansion member 455 moves radially inward at the predetermined load to ensure that a hanger 465 conforms to a surrounding casing 110 as the expander tool 450 urges the expandable hanger 465 radially outward.

Figure 20:
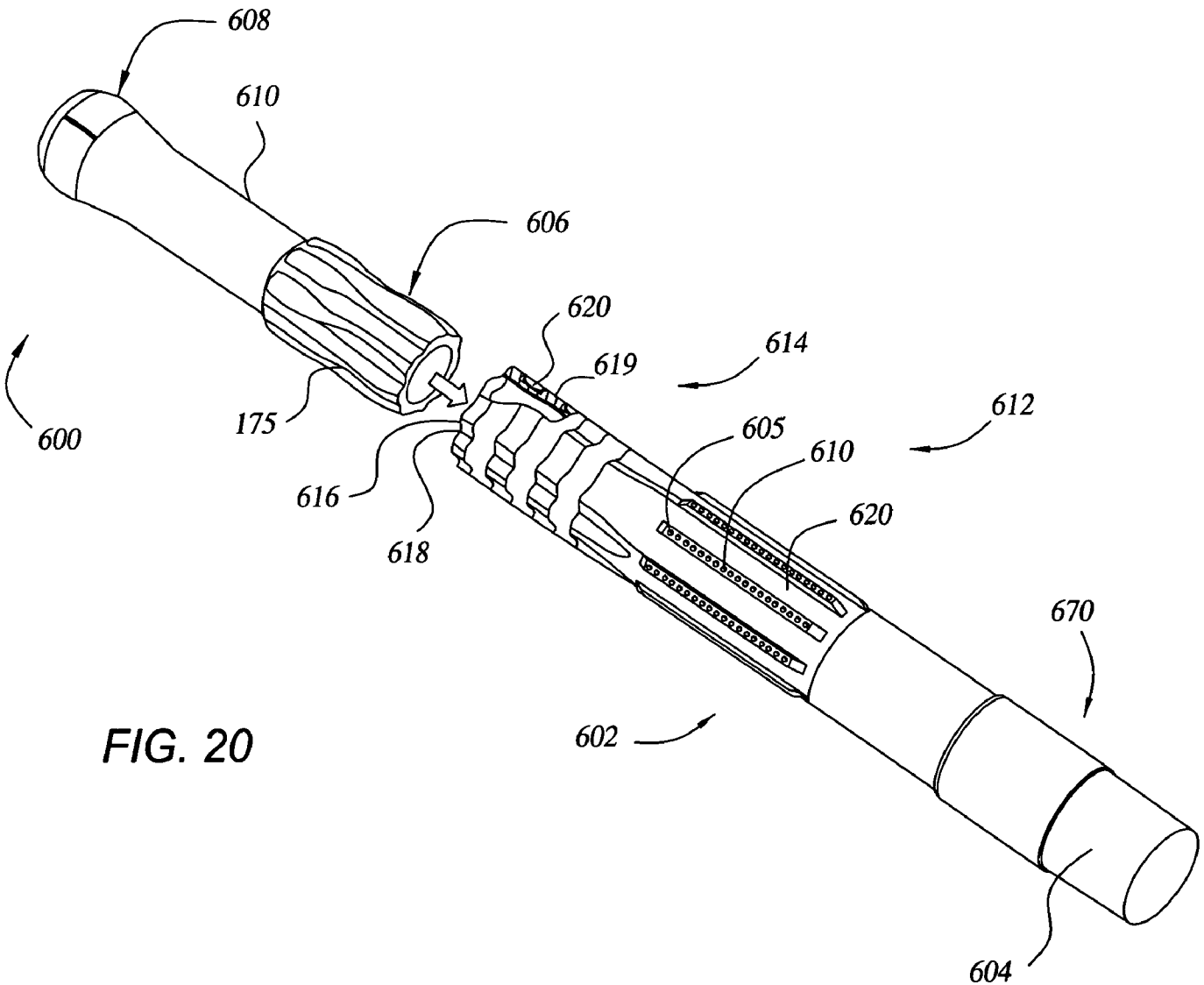
FIG. 20 is a perspective view illustrating an expander tool and an expandable packer and hanger according to one embodiment of the invention.

FIG. 20 illustrates an expansion tool 600 and an expandable assembly 602. The expandable assembly 602 is coupled to an upper end of a liner 604. The expansion tool 600 includes a fluted member 606 separated axially from a cone 608 by a length of tubing 610. In operation, the expansion tool 600 moves axially through an inner diameter of the expandable assembly 602 to expand a liner hanger 612 of the expandable assembly 602 and subsequently a packer 614 of the expandable assembly 602.

The liner hanger 612 can incorporate any of the expandable hangers disclosed heretofore such as the expandable hanger 200 shown in FIGS. 1-16. Similarly, any arrangement such as the mechanical mechanisms previously described for some embodiments or other hydraulic force application mechanisms can translate the expansion tool 600 axially through the expandable assembly 602. For some embodiments, the cone 608 and fluted member 606 may be independently moveable and not fixed relative to one another. Accordingly, the fluted member 606 may be selectively moved axially and thereafter the cone 608 moved axially at a desired time.

The liner hanger 602 includes ribs 605 extending outward along an outer surface of the liner hanger 602 to an outer diameter slightly less than a drift diameter of casing that the liner 604 is to be hung from. Flutes 620 circumferentially separate each of the ribs 605. To enhance gripping of the liner hanger 602 upon expansion into contact with surrounding casing, inserts 610 disposed along the ribs 605 can embed in the casing upon expansion. The inserts 610 can include hardened material pieces that can be oriented in substantially one direction to prevent relative movement in substantially only one direction. Orientation of the inserts 610 can also be in a multitude of directions or randomly along the ribs 605. Expanding the ribs 605 into engaging contact with surrounding casing advantageously requires a low expansion ratio since the ribs 605 provide a small gap with the casing prior to expansion. Further, the flutes 620 of the liner hanger 612 maintain desired fluid bypasses after expansion even though the ribs 605 enable the low expansion ratio.

Figure 21:
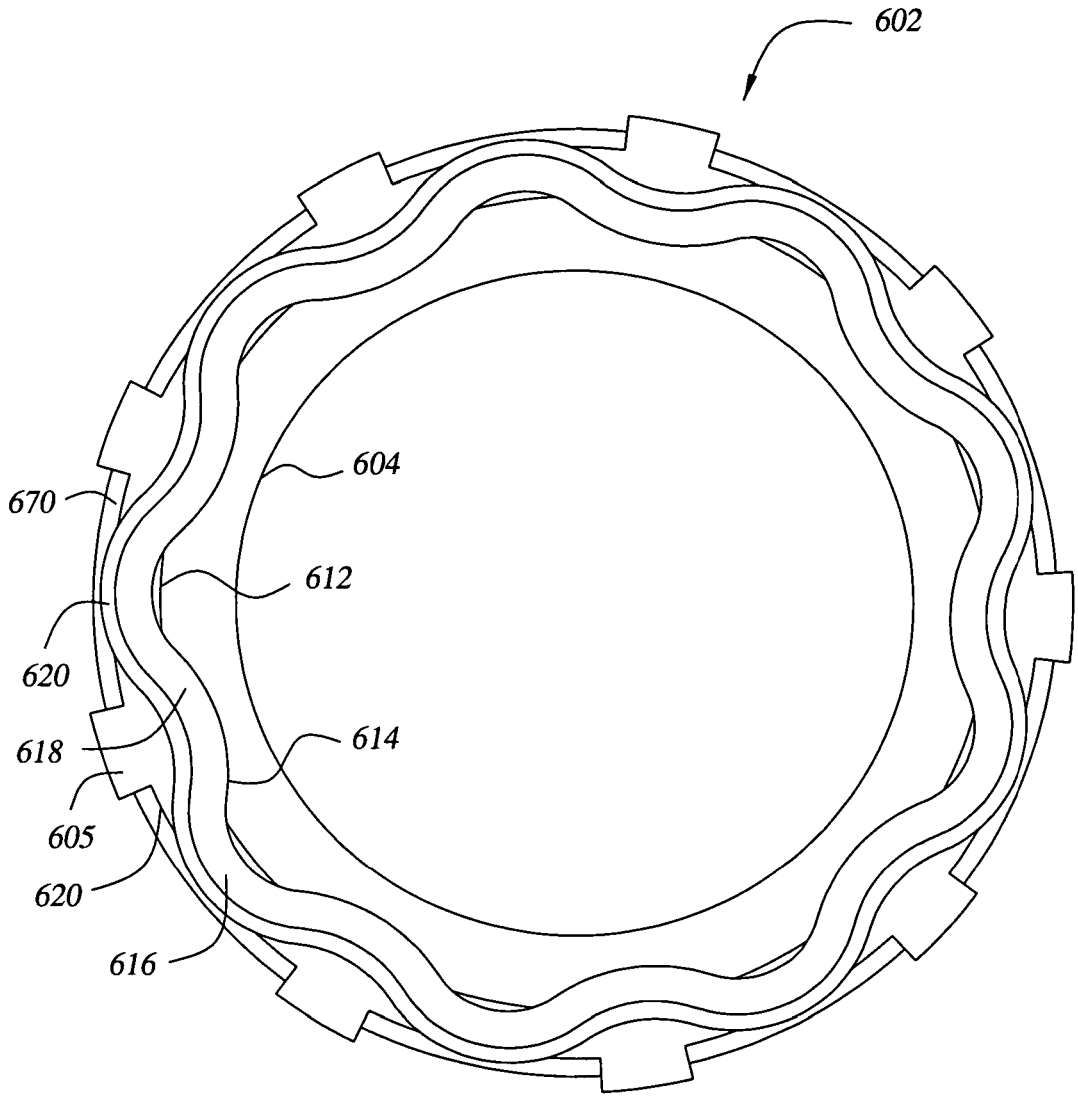
FIG. 21 is a top view illustrating the expandable packer and hanger prior to expansion.

FIG. 21 shows a top view illustrating the expandable assembly 602 prior to expansion. Referring to FIGS. 20 and 21, the packer 614 defines a longitudinal corrugated profile with crests 616. For some embodiments, forming a circular pipe section inward selectively and then stress relieving the pipe provides the corrugated profile of the packer 614. Prior to forming the corrugated profile, the circular pipe section can have an outer diameter that is slightly smaller than an inner diameter of the casing that the packer 614 is to be expanded against. Accordingly, expanding the packer 614 into engaging contact with the surrounding casing also beneficially requires a low expansion ratio. Additionally, the corrugated profile with a decreased outer diameter and troughs 618 between crests 616 enable fluid bypass around the packer 614.

Comparatively, the expandable assembly 602 provides improved fluid bypass while keeping expansion forces required at an achievable level due to the corrugated profile of the packer 614 and the flutes 620 and ribs 605 of the liner hanger 612. For example, a close standoff between an inner diameter of the casing and a tubing to be expanded is normally required to keep expansion ratios down. However, this close standoff creates a small annular area for limited fluid bypass without utilizing embodiments of the invention to increase the fluid bypass.

The packer 614 additionally can include circumferential projections 619 spaced axially along an outer surface of the packer 614. Elastomer elements 620 disposed between the circumferential projections 619 provide sealing capability for the packer 614. The projections 619 prevent extrusion of the elastomer elements 620 and otherwise provide backup for the elastomer elements 620 upon expansion of the packer 614. Consequently, a pressure rating of the packer 614 benefits from the elastomer elements 620 being disposed between the projections 619.

In operation, the fluted member 606 passes axially through the packer 614 without reconfiguring or expanding the packer 614. Due to ribs 175 of the fluted member 606 being rotationally aligned in phase with the crests 616 of the packer 614 and dimensions of the fluted member 606 and packer 614, the leading length of the fluted member 606 lacks interfering contact with the packer 614. Further axial progression of the expansion tool 600 through the expandable assembly 602 occurs once the expandable assembly 602 is positioned at a desired location in a wellbore in order to expand the liner hanger 612 such as shown in FIG. 4. As with other embodiments described herein, the expansion of the liner hanger 612 takes place by the ribs 175 of the fluted member 606 contacting an inside surface of the liner hanger 612 in an area of the flutes 620.

In one embodiment, the tubing 610 between the fluted member 606 and the cone 608 provides sufficient separation such that the cone 608 remains located outside of the packer 614 after the fluted member 606 passes through the liner hanger 612 to secure the expandable assembly 602 to the casing. At this point in time, cementation of the liner 604 can occur with fluid bypass provided across both the liner hanger 602 that is expanded and the packer 614 that still has the corrugated profile. Activation once again moves the expansion tool 600 axially through the expandable assembly 602 after completing the cementation. As the expansion tool 600 moves relative to the expandable assembly 602, the cone 608 reconfigures the shape of the packer 614 to circular and expands the packer 614 in a radial direction such that at least the elastomer elements 620 are in substantial contact with an inner surface of the casing.

In another embodiment, expansion of the packer 614 and the liner hanger 612 occurs simultaneously. This can require that the cement is pumped prior to the expansion of the liner hanger and the packer.

The cone 608 can be any device capable of expanding the packer 614 about substantially 360°. For example, the cone 608 can be a fixed diameter conical member with a uniform maximum outer diameter that is greater than an inner diameter of the packer 614. For some embodiments, the cone 608 can be compliant or semi-compliant meaning that the diameter of the cone 608 can at least partially fluctuate inwards to enable the packer 614 to conform to irregularities in the casing. This compliancy can be provided by segments of the cone that are biased in a manner that a predetermined load causes the segments to move inward such as occurs upon encountering a restriction.

Figure 22:
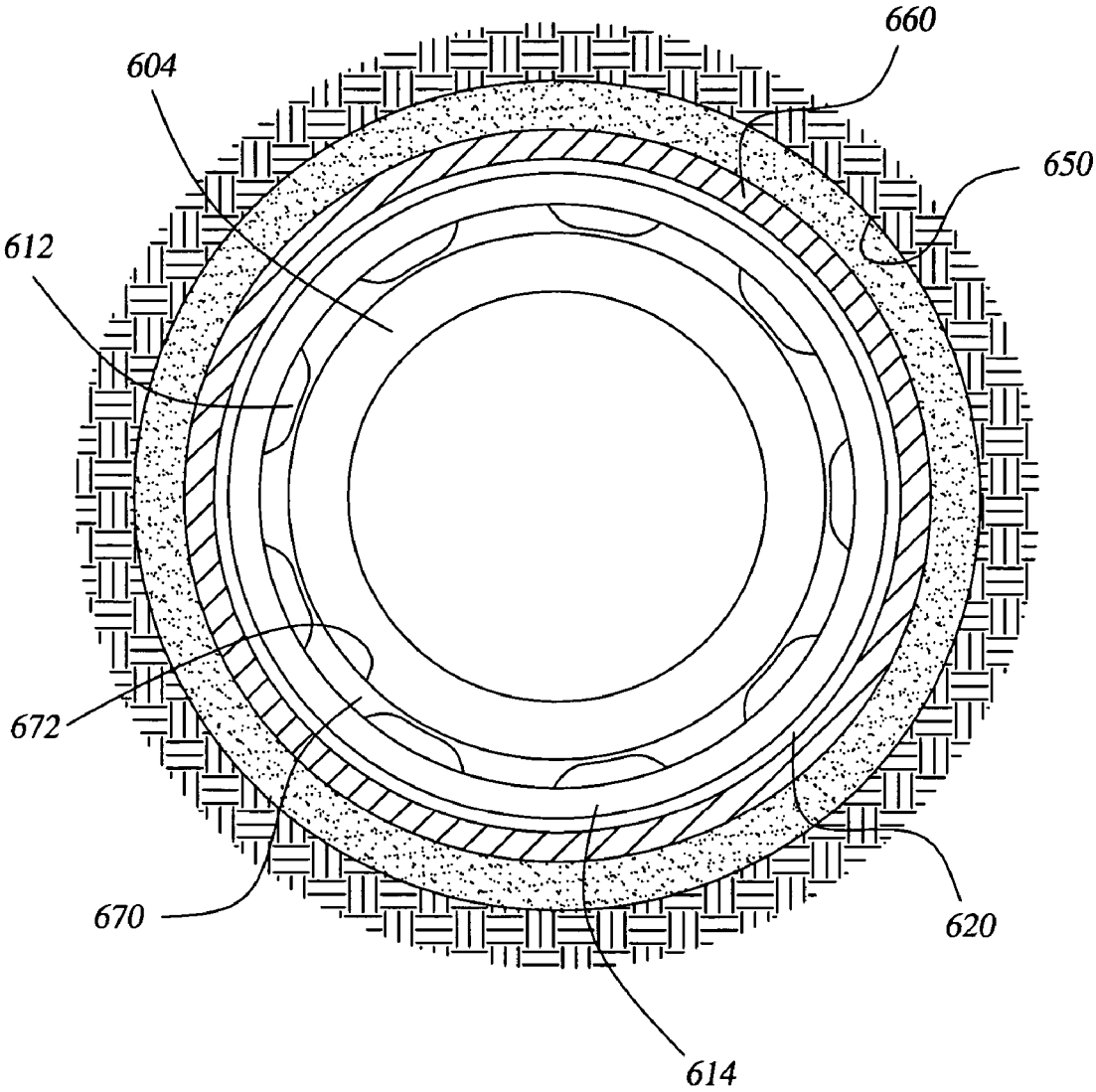
FIG. 22 is a cross-sectional view illustrating the expandable packer and hanger fully expanded in a wellbore after removal of the expander tool.

FIG. 22 illustrates a cross-sectional view of a wellbore 650 looking down on the expandable assembly 602 fully expanded into casing 660 after removal of the expansion tool 600. As shown in FIG. 20, an inline polish bore receptacle 670 can be provided between the liner hanger 612 and the liner 604. The polish bore receptacle 670 provides a smooth inside surface 672 configured to mate with sealing units stabbed into the polish bore receptacle 670. With reference to FIGS. 21 and 22, expansion of the packer 614 and liner hanger 612 opens a bore through the expandable assembly 602 to provide access to the inside surface 672 of the polish bore receptacle 670 without interference.

For some embodiments, an additional expandable sleeve (not shown) may be disposed inside the packer 614 and/or the liner hanger 612 to enhance collapse resistance of the expandable assembly 602. This additional expandable sleeve contacts an inner surface of the expandable assembly 602 to provide a cladding. Further, the additional expandable sleeve can be expanded with the packer 614 and/or the liner hanger 612 or run in and expanded in a second trip application.

While the foregoing is directed to embodiments of the present invention, other and further embodiments of the invention may be devised without departing from the basic scope thereof, and the scope thereof is determined by the claims that follow.

The invention claimed is:

1. A system for completing installation of a liner in a wellbore, comprising:

a longitudinally corrugated packer having a sealing element disposed on an outer surface thereof; and a liner hanger coupled with the packer and the liner, wherein a plurality of formations extend outward along an outer surface of the liner hanger to form interspaces for longitudinal fluid flow between the plurality of formations, wherein the formations comprise raised portions around the outer surface that otherwise defines a substantially circular profile.

2. The system of claim 1, wherein the sealing element is disposed between circumferential projections along an outer surface of the packer.

3. The system of claim 1, further comprising a polish bore receptacle disposed between the liner and the liner hanger.

4. The system of claim 1, wherein the liner hanger is disposed between the liner and the packer.

5. The system of claim 1, wherein the sealing element comprises an elastomeric material.

6. A system for completing installation of a liner in a wellbore, comprising:

a longitudinally corrugated packer having a sealing element disposed on an outer surface thereof;

a liner hanger coupled with the packer and the liner, wherein a plurality of formations extend outward along an outer surface of the liner hanger to form interspaces for longitudinal fluid flow between the plurality of formations; and an expansion tool operatively coupled with the hanger and packer, wherein the expansion tool comprises a fluted member and a conical member having a substantially uniform maximum outer diameter.

7. The system of claim 6, wherein the fluted and conical members are separated a predetermined distance from one another based on a length of the packer and hanger combined.

8. A system for completing installation of a liner in a wellbore, comprising:

a longitudinally corrugated packer having a sealing element disposed on an outer surface thereof;

a liner hanger coupled with the packer and the liner, wherein a plurality of formations extend outward along an outer surface of the liner hanger to form interspaces for longitudinal fluid flow between the plurality of formations; and a fluted expander for expanding the liner hanger, wherein the fluted expander is dimensioned to pass through the packer substantially without interference.

9. The system of claim 8, wherein the fluted expander is operatively coupled with the hanger to permit longitudinal relative movement between the expander and the hanger and rotationally align protrusions of the expander with crests of the corrugated packer and the interspaces of the hanger.

10. A system for completing installation of a liner in a wellbore, comprising:

a longitudinally corrugated packer having a sealing element disposed on an outer surface thereof;

a liner hanger coupled with the packer and the liner, wherein a plurality of formations extend outward along an outer surface of the liner hanger to form interspaces for longitudinal fluid flow between the plurality of formations, wherein crests of the packer correspond in rotational alignment with the interspaces on the liner hanger.

11. A system for completing installation of a liner in a wellbore, comprising:

a longitudinally corrugated packer having a sealing element disposed on an outer surface thereof;

a liner hanger coupled with the packer and the liner, wherein a plurality of formations extend outward along an outer surface of the liner hanger to form interspaces for longitudinal fluid flow between the plurality of formations; and hard inserts disposed along the formations.

12. The system of claim 11, wherein the inserts are oriented in substantially one direction.

13. A method of completing installation of tubing in a wellbore, comprising:

running a first tubular into the wellbore to a position coaxially within a portion of a second tubular disposed in the wellbore, wherein a first length of the first tubular is distinct from and above a second length of the first tubular;

expanding the second length of the first tubular into gripping contact with the second tubular without altering a corrugated profile of the first length, wherein circumferentially separated longitudinal areas of the second length remain spaced from the second tubular to provide a flow path after expanding the second length; and expanding the first length of the first tubular into circumferential sealing contact with the second tubular after expanding the second length.

14. The method of claim 13, wherein expanding the first length includes passing a conical member having a substantially uniform maximum outer diameter through the first length.

15. The method of claim 13, wherein expanding the first length includes passing an at least partially compliant cone through the first length, wherein an outer diameter of the cone is capable of deforming in response to restrictions.

16. The method of claim 13, wherein expanding the second length includes passing a fluted member through the second length.

17. The method of claim 13, wherein expanding the second length includes passing a fluted member through the second length while ribs of the fluted member are rotationally misaligned with formations extending outward along an outer surface of the second length.

18. The method of claim 13, wherein expanding the first length places a seal disposed on an outside of the first length into contact with the second tubular.

19. A method of completing installation of a liner in a wellbore, comprising:

providing a packer comprising tubing with a longitudinally corrugated profile;

providing a liner hanger coupled with the packer and the liner, wherein a plurality of circumferentially spaced longitudinal formations extend outward along an outer surface of the liner hanger;

moving an expander longitudinally through the liner hanger while a plurality of protrusions on the expander are misaligned with the formations, thereby expanding the liner hanger in a radial direction to place the formations into frictional contact with a surrounding tubular disposed in the wellbore leaving a flow path between the formations; and expanding the packer into circumferential sealing contact with the surrounding tubular after expanding the liner hanger.

20. The method of claim 19, wherein expanding the packer places a seal disposed on an outside of the packer into contact with the surrounding tubular.

* * * * *